US009995517B2

(12) United States Patent
Kibo et al.

(10) Patent No.: US 9,995,517 B2
(45) Date of Patent: Jun. 12, 2018

(54) OPERATION CONTROL APPARATUS OF AIR-CONDITIONING APPARATUS AND AIR-CONDITIONING APPARATUS COMPRISING SAME

(75) Inventors: Kousuke Kibo, Sakai (JP); Kazuhiko Tani, Sakai (JP); Masahiro Oka, Sakai (JP); Shinichi Kasahara, Sakai (JP); Yasuyuki Aisaka, Sakai (JP); Shingo Ohnishi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1028 days.

(21) Appl. No.: 13/696,980

(22) PCT Filed: Apr. 22, 2011

(86) PCT No.: PCT/JP2011/059924

§ 371 (c)(1),
(2), (4) Date: Nov. 8, 2012

(87) PCT Pub. No.: WO2011/142234

PCT Pub. Date: Nov. 17, 2011

(65) Prior Publication Data

US 2013/0067944 A1 Mar. 21, 2013

(30) Foreign Application Priority Data

May 11, 2010 (JP) ..... 2010-109042
Mar. 31, 2011 (JP) ..... 2011-078717

(51) Int. Cl.
*F24F 11/00* (2018.01)
*F25B 49/02* (2006.01)
*F25B 13/00* (2006.01)

(52) U.S. Cl.
CPC ..... *F25B 49/02* (2013.01); *F24F 11/46* (2018.01); *F24F 11/83* (2018.01); *F24F 11/30* (2018.01);

(Continued)

(58) Field of Classification Search
CPC ..... F25B 49/02; F25B 49/027; F25B 2313/02331; F25B 2313/02334
See application file for complete search history.

(56) References Cited

U.S. PATENT DOCUMENTS 4,671,075 A * 6/1987 Iijima ..... F25B 1/00 62/196.1
4,873,649 A * 10/1989 Grald ..... F24F 11/0009 62/176.6

(Continued)

FOREIGN PATENT DOCUMENTS

EP 2 261 580 A1 12/2010
JP 60-14032 A 1/1985

(Continued)

OTHER PUBLICATIONS

International Search Report of corresponding PCT Application No. PCT/JP2011/059924.

(Continued)

*Primary Examiner* — Ljiljana Ciric
*Assistant Examiner* — Alexis Cox
(74) *Attorney, Agent, or Firm* — Global IP Counselors, LLP

(57) ABSTRACT

An operation control apparatus of air-conditioning apparatus having an outdoor unit and an indoor unit includes a controller programmed to execute energy conservation control of the air conditioning apparatus. The controller includes at least one required temperature calculation part calculating a required evaporation temperature or a required condensation temperature based on either a current amount of heat exchanged in a usage-side heat exchanger of the indoor unit and a greater amount of heat exchanged in the usage-side heat exchanger than the current amount, or an operating state amount that yields the current amount of heat exchanged in the usage-side heat exchanger and an operating state amount (Continued)

that yields the greater amount of heat exchanged in the usage-side heat exchanger than the current amount.

16 Claims, 7 Drawing Sheets

(52) U.S. Cl.
CPC ..... *F24F 2110/10* (2018.01); *F24F 2140/20* (2018.01); *F25B 13/00* (2013.01); *F25B 2313/023* (2013.01); *F25B 2313/02741* (2013.01); *F25B 2500/19* (2013.01); *F25B 2700/2116* (2013.01); *F25B 2700/2117* (2013.01)

(56) References Cited

U.S. PATENT DOCUMENTS

| | | | | |
|---|---|---|---|---|
| 5,303,561 | A * | 4/1994 | Bahel | F24F 1/0003 62/160 |
| 5,475,986 | A * | 12/1995 | Bahel | F24F 1/00 236/51 |
| 2003/0010047 | A1 * | 1/2003 | Shimoda | F25B 13/00 62/228.3 |
| 2005/0210897 | A1 | 9/2005 | Oomura et al. | |
| 2006/0254294 | A1 * | 11/2006 | Shimamoto | F24F 3/065 62/238.7 |
| 2011/0023534 | A1 | 2/2011 | Kasahara | |
| 2012/0303311 | A1 * | 11/2012 | Rowe, Jr. | F04B 49/065 702/130 |

FOREIGN PATENT DOCUMENTS

| | | | |
|---|---|---|---|
| JP | 63-25446 | A | 2/1988 |
| JP | 2-57875 | A | 2/1990 |
| JP | 11-281222 | A | 10/1999 |
| JP | 2007-33002 | | 2/2007 |
| JP | 2009-243810 | A | 10/2009 |
| JP | 2009-243832 | A | 10/2009 |
| WO | 2009/119023 | A1 | 10/2009 |

OTHER PUBLICATIONS

International Preliminary Report of corresponding PCT Application No. PCT/JP2011/059924.

European Search Report of corresponding EP Application No. 11 78 0491.4 dated Feb. 28, 2018.

* cited by examiner

OPERATION CONTROL APPARATUS OF AIR-CONDITIONING APPARATUS AND AIR-CONDITIONING APPARATUS COMPRISING SAME

CROSS-REFERENCE TO RELATED APPLICATIONS

This U.S. National Stage application claims priority under 35 U.S.C. § 119(a) to Japanese Patent Application Nos. 2010-1090042, filed in Japan on May 11, 2010 and 2011-078717, filed on Mar. 31, 2011, the entire contents of which are hereby incorporated herein by reference.

TECHNICAL FIELD

The present invention relates to an operation control apparatus of an air-conditioning apparatus, and an air-conditioning apparatus comprising the operation control apparatus.

BACKGROUND ART

In conventional practice, there is an operation control apparatus of an air-conditioning apparatus having a plurality of indoor units, shown in Japanese Lid-Open Patent Application No. 2-57875. With this operation control apparatus of an air-conditioning apparatus, operating efficiency is improved and energy is conserved by establishing the operating capacity of a compressor on the basis of a maximum required capability, which is the greatest of the required capabilities calculated in the indoor units.

SUMMARY

However, with the above conventional operation control apparatus of an air-conditioning apparatus, the required capabilities in the indoor untis are calculated based only on the temperature difference between the room temperature and the set temperature at the time, and other factors (e.g. air flow rate, degree of superheat, degree of subcooling, etc.) are not taken into account. Consequently, with the above conventional operation control apparatus of an air-conditioning apparatus, operating efficiency is not always being improved, and there are cases in which energy is not conserved.

An object of the present invention is to improve operating efficiency and conserve energy in an air-conditioning apparatus.

The operation control apparatus of an air-conditioning apparatus according to a first aspect of the present invention is part of an air-conditioning apparatus that has an outdoor unit and an indoor unit that includes a usage-side heat exchanger, the air-conditioning apparatus performing indoor temperature control for controlling equipment provided to the indoor unit so that an indoor temperature approaches a set temperature, wherein the operation control apparatus comprises a required temperature calculation part for calculating a required evaporation temperature or a required condensation temperature on the basis of either a current amount of heat exchanged in the usage-side heat exchanger and a greater amount of heat exchanged in the usage-side heat exchanger than the current amount, or an operating state amount that yields the current amount of heat exchanged in the usage-side heat exchanger and an operating state amount that yields a greater amount of heat exchanged in the usage-side heat exchanger than the current amount.

Consequently, in the operation control apparatus of the air-conditioning apparatus of the present invention, the required evaporation temperature or the required condensation temperature is calculated in a state that yields a better capability of the usage-side heat exchanger, because the required temperature calculation part calculates the required evaporation temperature or the required condensation temperature on the basis of either the current amount of heat exchanged in the usage-side heat exchanger and the greater amount of heat exchanged in the usage-side heat exchanger than the current amount, or the operating state amount that yields the current amount of heat exchanged in the usage-side heat exchanger and the operating state amount that yields the greater amount of heat exchanged in the usage-side heat exchanger than the current amount. It is therefore possible to find the required evaporation temperature or the required condensation temperature of a state that sufficiently improves the operating efficiency of the indoor unit, and the operating efficiency can thereby be sufficiently improved.

The operation control apparatus of an air-conditioning apparatus according to a second aspect of the present invention is the operation control apparatus of an air-conditioning apparatus according to the first aspect, the indoor unit having an air blower capable of adjusting an air flow rate within a predetermined air flow rate range as equipment controlled in the indoor temperature control. The required temperature calculation part uses at least a current air flow rate of the air blower and an air flow rate greater than the current air flow rate within the predetermined air flow rate range as the operating state amount that yields the current amount of heat exchanged in the usage-side heat exchanger and the operating state amount that yields the greater amount of heat exchanged in the usage-side heat exchanger than the current amount, when calculating the required evaporation temperature or the required condensation temperature.

Consequently, in the operation control apparatus of an air-conditioning apparatus of the present invention, the required evaporation temperature or the required condensation temperature is calculated in a state that yields a better capability of the usage-side heat exchanger, because the required temperature calculation part calculates the required evaporation temperature or the required condensation temperature on the basis of the current air flow rate of the air blower and the air flow rate greater than the current air flow rate within a predetermined air flow rate range. It is therefore possible to find the required evaporation temperature or the required condensation temperature of a state that sufficiently improves the operating efficiency of the indoor unit, and the operating efficiency can thereby be sufficiently improved.

The operation control apparatus of an air-conditioning apparatus according to a third aspect of the present invention is the operation control apparatus of an air-conditioning apparatus according to the first or second aspect, the air-conditioning apparatus having, as equipment controlled in the indoor temperature control, an expansion mechanism capable of regulating a degree of superheat or a degree of subcooling in an outlet of the usage-side heat exchanger by regulating an opening degree of the expansion mechanism. The required temperature calculation part uses at least either a degree of superheat less than a current degree of superheat within a range of degrees of superheat in which the degree of superheat can be set by regulating the opening degree of the expansion mechanism as well as the current degree of superheat, or a degree of subcooling less than a current degree of subcooling within a range of degrees of subcooling in which the degree of subcooling can be set by regulating the opening degree of the expansion mechanism as well as the current degree of subcooling, as the operating state amount that yields the current amount of heat exchanged in the usage-side heat exchanger and the operating state amount that yields the greater amount of heat exchanged in the usage-side heat exchanger than the current amount, when calculating the required evaporation temperature or the required condensation temperature.

Consequently, in the operation control apparatus of an air-conditioning apparatus of the present invention, the required evaporation temperature or the required condensation temperature is calculated in a state that yields a better capability of the usage-side heat exchanger, because the required temperature calculation part calculates the required evaporation temperature or the required condensation temperature on the basis of either the current degree of superheat and the degree of superheat less than the current degree of superheat within the range of degrees of superheat in which the degree of superheat can be set by regulating the opening degree of the expansion mechanism, or the current degree of subcooling and the degree of subcooling less than the current degree of subcooling within the range of degrees of subcooling in which the degree of subcooling can be set by regulating the opening degree of the expansion mechanism. It is therefore possible to find the required evaporation temperature or the required condensation temperature of a state that sufficiently improves the operating efficiency of the indoor unit, and the operating efficiency can thereby be sufficiently improved.

The operation control apparatus of an air-conditioning apparatus according to a fourth aspect of the present invention is the operation control apparatus of an air-conditioning apparatus according to the first aspect, the indoor unit having an air blower capable of adjusting an air flow rate within a predetermined air flow rate range as equipment controlled in the indoor temperature control. The required temperature calculation part uses at least a current air flow rate of the air blower and an air flow rate maximum value that is the air flow rate of the air blower maximized within the predetermined air flow rate range, as the operating state amount that yields the current amount of heat exchanged in the usage-side heat exchanger and the operating state amount that yields the greater amount of heat exchanged in the usage-side heat exchanger than the current amount, when calculating the required evaporation temperature or the required condensation temperature.

Consequently, in the operation control apparatus of an air-conditioning apparatus of the present invention, the required evaporation temperature or the required condensation temperature is calculated in a state that yields a better capability of the usage-side heat exchanger, because the required temperature calculation part calculates the required evaporation temperature or the required condensation temperature on the basis of the current air flow rate of the air blower and the air flow rate maximum value. It is therefore possible to find the required evaporation temperature or the required condensation temperature of a state that sufficiently improves the operating efficiency of the indoor unit, and the operating efficiency can thereby be sufficiently improved.

The operation control apparatus of an air-conditioning apparatus according to a fifth aspect of the present invention is the operation control apparatus of an air-conditioning apparatus according to the first or fourth aspect, the air-conditioning apparatus having, as equipment controlled in the indoor temperature control, an expansion mechanism capable of regulating a degree of superheat or a degree of subcooling in an outlet of the usage-side heat exchanger by regulating an opening degree of the expansion mechanism. The required temperature calculation part uses at least either a current degree of superheat and a degree of superheat minimum value which is a minimum in a range of degrees of superheat in which the degree of superheat can be set by regulating the opening degree of the expansion mechanism, or a current degree of subcooling and a degree of subcooling minimum value which is a minimum in a range of degrees of subcooling in which the degree of subcooling can be set by regulating the opening degree of the expansion mechanism, as the operating state amount that yields the current amount of heat exchanged in the usage-side heat exchanger and the operating state amount that yields the greater amount of heat exchanged in the usage-side heat exchanger than the current amount, when calculating the required evaporation temperature or the required condensation temperature.

Consequently, in the operation control apparatus of an air-conditioning apparatus of the present invention, the required evaporation temperature or the required condensation temperature is calculated in a state that yields a better capability of the usage-side heat exchanger, because the required temperature calculation part calculates the required evaporation temperature or the required condensation temperature on the basis of either the current degree of superheat and the degree of superheat minimum value or the current degree of subcooling and the degree of subcooling minimum value. It is therefore possible to find the required evaporation temperature or the required condensation temperature of a state that sufficiently improves the operating efficiency of the indoor unit, and the operating efficiency can thereby be sufficiently improved.

The operation control apparatus of an air-conditioning apparatus according to a sixth aspect of the present invention is the operation control apparatus of an air-conditioning apparatus according to any of the first through fifth aspects, wherein the outdoor unit has a compressor. The operation control apparatus performs capacity control of the compressor on the basis of a target evaporation temperature or a target condensation temperature, and uses the required evaporation temperature or the required condensation temperature as the target evaporation temperature or the target condensation temperature.

The operation control apparatus of an air-conditioning apparatus according to a seventh aspect of the present invention is the operation control apparatus of an air-conditioning apparatus according to the first aspect, wherein there are a plurality of indoor units, the indoor temperature control is performed for the each indoor unit, and the required temperature calculation parts calculate the required evaporation temperature or the required condensation temperature for the each indoor unit. The operation control apparatus either establishes a target evaporation temperature on the basis of a minimum required evaporation temperature among the required evaporation temperatures of each of the indoor units calculated in the required temperature calculation parts, or establishes a target condensation temperature on the basis of a maximum required condensation temperature among the required condensation temperatures of each of the indoor units calculated in the required temperature calculation parts.

Consequently, in the operation control apparatus of an air-conditioning apparatus of the present invention, the target evaporation temperature (the target condensation temperature) can be established in accordance with the indoor unit that has the greatest required air-conditioning capability among the indoor units whose operating efficiency has been sufficiently improved, and operating efficiency can thereby be sufficiently improved without causing any capability deficiency in a plurality of the indoor units.

The operation control apparatus of an air-conditioning apparatus according to an eighth aspect of the present invention is the operation control apparatus of an air-conditioning apparatus according to the seventh aspect, wherein the indoor units have air blowers capable of adjusting air flow rate in a predetermined air flow rate range as equipment controlled in the indoor temperature control. The required temperature calculation parts use at least current air flow rates of the air blowers and air flow rates greater than the current air flow rates within the predetermined air flow rate range as the operating state amount that yields the current amounts of heat exchanged in the usage-side heat exchangers and the operating state amount that yields the greater amounts of heat exchanged in the usage-side heat exchangers than the current amounts, when calculating the required evaporation temperatures or the required condensation temperatures for the each indoor unit.

Consequently, in the operation control apparatus of an air-conditioning apparatus of the present invention, the required evaporation temperatures or the required condensation temperatures are calculated in a state that yields a better capability of the usage-side heat exchangers, because the required temperature calculation parts calculate the required evaporation temperatures or the required condensation temperatures on the basis of the current air flow rates of the air blowers and air flow rates greater than the current air flow rates within the predetermined air flow rate range. It is therefore possible to find the required evaporation temperatures (or the required condensation temperatures) of a state that sufficiently improves the operating efficiency of the indoor units, and the minimum (maximum) required evaporation temperature (required condensation temperature) of these required evaporation temperatures (or required condensation temperatures) can be used to achieve the target evaporation temperature (target condensation temperature). The target evaporation temperature (target condensation temperature) can thereby be established in accordance with the indoor unit that has the greatest required air-conditioning capability among the indoor units whose operating efficiency has been sufficiently improved, and operating efficiency can be sufficiently improved without causing any capability deficiency in a plurality of the indoor units.

The operation control apparatus of an air-conditioning apparatus according to a ninth aspect of the present invention is the operation control apparatus of an air-conditioning apparatus according to the seventh or eighth aspect, wherein the air-conditioning apparatus has, as equipment controlled in the indoor temperature control, a plurality of expansion mechanisms that correspond to each of the indoor units and that can regulate degrees of superheat or degrees of subcooling in the outlets of the usage-side heat exchangers by regulating the opening degrees of the expansion mechanisms. The required temperature calculation parts, when calculating the required evaporation temperature or the required condensation temperature for the each indoor unit, use at least either current degrees of superheat and degrees of superheat less than the current degrees of superheat within a range of degrees of superheat in which the degrees of superheat can be set by regulating the opening degrees of the expansion mechanisms, or current degrees of subcooling and degrees of subcooling less than the current degrees of subcooling within a range of degrees of subcooling in which the degrees of subcooling can be set by regulating the opening degrees of the expansion mechanisms, as the operating state amount that yields the current amounts of heat exchanged in the usage-side heat exchangers and the operating state amount that yields the greater amounts of heat exchanged in the usage-side heat exchangers than the current amounts.

Consequently, in the operation control apparatus of an air-conditioning apparatus of the present invention, the required evaporation temperatures or the required condensation temperatures are calculated in a state that yields a better capability of the usage-side heat exchangers, because the required temperature calculation parts calculate the required evaporation temperatures or the required condensation temperatures on the basis of either the current degrees of superheat and degrees of superheat less than the current degrees of superheat within the range of degrees of superheat in which the degrees of superheat can be set by regulating the opening degrees of the expansion mechanisms, or the current degrees of subcooling and the degrees of subcooling less than the current degrees of subcooling within the range of degrees of subcooling in which the degrees of subcooling can be set by regulating the opening degrees of the expansion mechanisms. It is therefore possible to find the required evaporation temperatures (or the required condensation temperatures) of a state that sufficiently improves the operating efficiency of the indoor units, and the minimum (maximum) required evaporation temperature (required condensation temperature) of these required evaporation temperatures (or required condensation temperatures) can be used to achieve the target evaporation temperature (target condensation temperature). The target evaporation temperature (target condensation temperature) can thereby be established in accordance with the indoor unit that has the greatest required air-conditioning capability among the indoor units whose operating efficiency has been sufficiently improved, and operating efficiency can be sufficiently improved without causing any capability deficiency in a plurality of the indoor units.

The operation control apparatus of an air-conditioning apparatus according to a tenth aspect of the present invention is the operation control apparatus of an air-conditioning apparatus according to the seventh aspect, wherein the indoor units have air blowers capable of adjusting air flow rate in a predetermined air flow rate range as equipment controlled in the indoor temperature control. The required temperature calculation parts use at least current air flow rates of the air blowers and an air flow rate maximum value that is the air flow rates of the air blowers maximized within the predetermined air flow rate range as the operating state amount that yields the current amounts of heat exchanged in the usage-side heat exchangers and the operating state amount that yields the greater amounts of heat exchanged in the usage-side heat exchangers than the current amounts, when calculating the required evaporation temperatures or the required condensation temperatures for the each indoor unit.

Consequently, in the operation control apparatus of an air-conditioning apparatus of the present invention, the required evaporation temperatures or the required condensation temperatures are calculated in a state that yields a better capability of the usage-side heat exchangers, because the required temperature calculation parts calculate the required evaporation temperatures or the required condensation temperatures on the basis of the current air flow rates of the air blowers and the air flow rate maximum value. It is therefore possible to find the required evaporation temperatures (or the required condensation temperatures) of a state that sufficiently improves the operating efficiency of the indoor units, and the minimum (maximum) required evaporation temperature (required condensation temperature) of these required evaporation temperatures (or required condensation temperatures) can be used to achieve the target evaporation temperature (target condensation temperature). The target evaporation temperature (target condensation temperature) can thereby be established in accordance with the indoor unit that has the greatest required air-conditioning capability among the indoor units whose operating efficiency has been sufficiently improved, and operating efficiency can be sufficiently improved without causing any capability deficiency in a plurality of the indoor units.

The operation control apparatus of an air-conditioning apparatus according to an eleventh aspect of the present invention is the operation control apparatus of an air-conditioning apparatus according to the seventh or tenth aspect, wherein the air-conditioning apparatus has, as equipment controlled in the indoor temperature control, a plurality of expansion mechanisms that correspond to each of the indoor units and that can regulate degrees of superheat or degrees of subcooling in the outlets of the usage-side heat exchangers by regulating opening degrees of the expansion mechanisms. The required temperature calculation parts, when calculating the required evaporation temperature or the required condensation temperature for the each indoor unit, use at least either current degrees of superheat and a degree of superheat minimum value which is the minimum in a range of degrees of superheat in which the degrees of superheat can be set by regulating the opening degrees of the expansion mechanisms, or current degrees of subcooling and a degree of subcooling minimum value which is the minimum in a range of degrees of subcooling in which the degrees of subcooling can be set by regulating the opening degrees of the expansion mechanisms, as the operating state amount that yields the current amounts of heat exchanged in the usage-side heat exchangers and the operating state amount that yields the greater amounts of heat exchanged in the usage-side heat exchangers than the current amounts.

Consequently, in the operation control apparatus of an air-conditioning apparatus of the present invention, the required evaporation temperatures or the required condensation temperatures are calculated in a state that yields a better capability of the usage-side heat exchangers, because the required temperature calculation parts calculate the required evaporation temperatures or the required condensation temperatures on the basis of either the current degrees of superheat in the outlets of the usage-side heat exchangers whose expansion mechanisms are regulated as well as the degree of superheat minimum value, or the current degrees of subcooling and the degree of subcooling minimum value. It is therefore possible to find the required evaporation temperatures (or the required condensation temperatures) of a state that sufficiently improves the operating efficiency of the indoor units, and the minimum (maximum) required evaporation temperature (required condensation temperature) of these required evaporation temperatures (or required condensation temperatures) can be used to achieve the target evaporation temperature (target condensation temperature). The target evaporation temperature (target condensation temperature) can thereby be established in accordance with the indoor unit that has the greatest required air-conditioning capability among the indoor units whose operating efficiency has been sufficiently improved, and operating efficiency can be sufficiently improved without causing any capability deficiency in a plurality of the indoor units.

The operation control apparatus of an air-conditioning apparatus according to a twelfth aspect of the present invention is the operation control apparatus of an air-conditioning apparatus according to any of the seventh through eleventh aspects, wherein the outdoor unit has a compressor. The operation control apparatus performs capacity control of the compressor on the basis of the target evaporation temperature or the target condensation temperature.

Consequently, in the operation control apparatus of an air-conditioning apparatus of the present invention, the required evaporation temperature (required condensation temperature) in the indoor unit having the greatest required air-conditioning capability can be set as the target evaporation temperature (target condensation temperature). Therefore, the target evaporation temperature (target condensation temperature) can be set so that there is no excess or deficiency in the indoor unit having the greatest required air-conditioning capability, and the compressor can be driven with the minimum necessary capacity.

The operation control apparatus of an air-conditioning apparatus according to a thirteenth aspect of the present invention is the operation control apparatus of an air-conditioning apparatus according to any of either the second through fifth aspects or the eighth through eleventh aspects, further comprising an air-conditioning capability calculation part for calculating the amount of heat exchanged in the usage-side heat exchangers on the basis of the air flow rate of the air blowers and/or the degree of superheat or degree of subcooling in the outlets of the usage-side heat exchangers.

Thus, in the operation control apparatus of an air-conditioning apparatus of the present invention, the required evaporation temperature or the required condensation temperature (the target evaporation temperature or the target condensation temperature) can be found accurately because the amount of heat exchanged in the usage-side heat exchanger is calculated. Consequently, the required evaporation temperature or the required condensation temperature (the target evaporation temperature or the target condensation temperature) can be brought to the proper value accurately, the evaporation temperature can be prevented from rising by too much, and the condensation temperature can be prevented from falling by too much. Therefore, the indoor unit can be brought to the optimal state quickly and stably, and an energy conservation effect can be better achieved.

An air-conditioning apparatus according to a fourteenth aspect of the present invention comprises the outdoor unit, the indoor unit including the usage-side heat exchanger, and the operation control apparatus according to any of the first through thirteenth aspects.

DESCRIPTION OF EMBODIMENTS

The following is a description, made based on the drawings, of an embodiment of the operation control apparatus of an air-conditioning apparatus according to the present invention and an air-conditioning apparatus comprising the operation control apparatus.

First Embodiment

(1) Configuration of Air-Conditioning Apparatus

Figure 1:
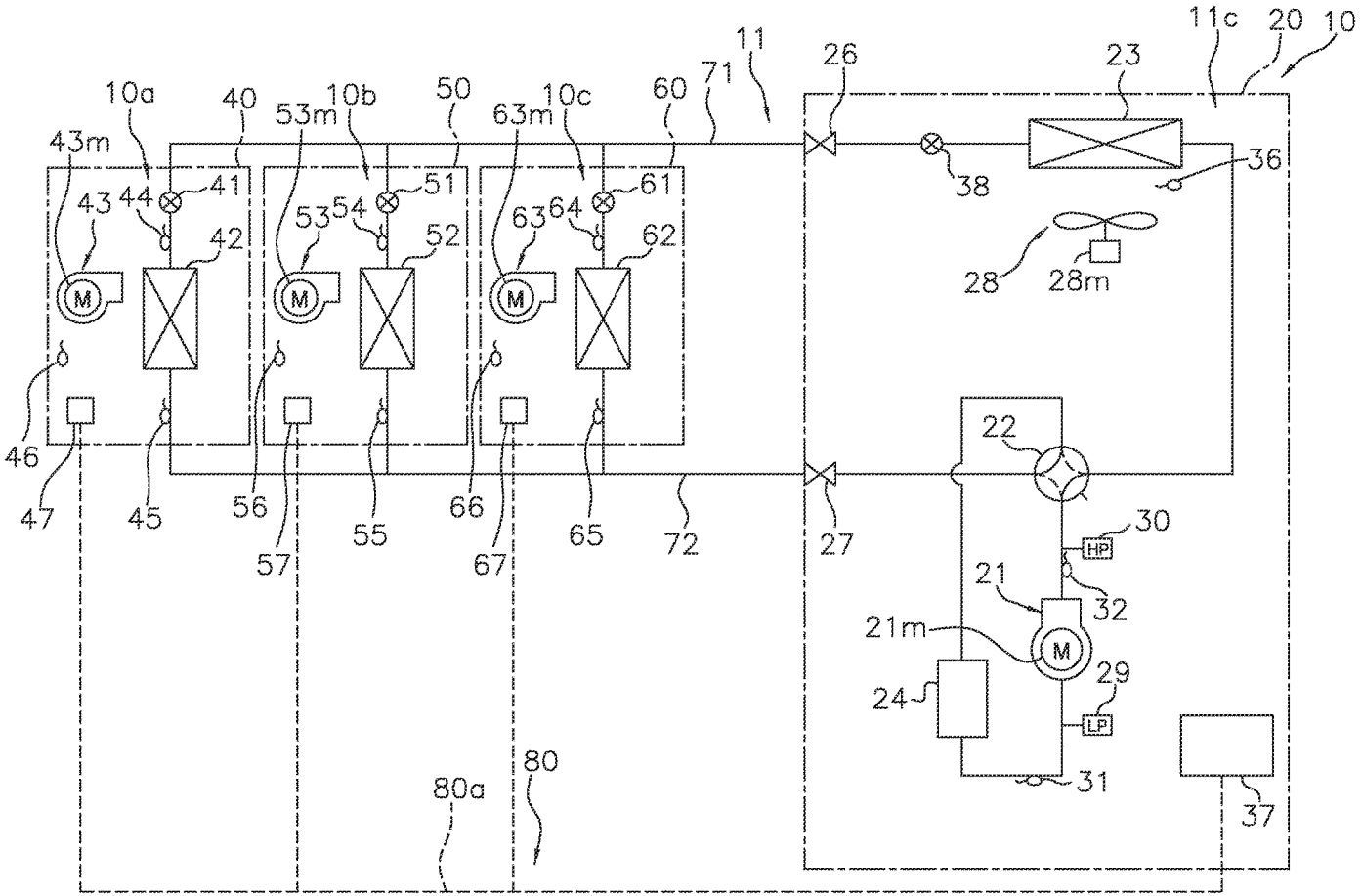
FIG. 1 is a schematic configuration view of an air-conditioning apparatus 10 according to an embodiment of the present invention.

FIG. 1 is a schematic configuration view of an air-conditioning apparatus 10 according to an embodiment of the present invention. The air-conditioning apparatus 10 is an apparatus used to cool and warm the air in the room of a building or the like by performing a vapor compression refrigeration cycle operation. The air-conditioning apparatus 10 comprises primarily an outdoor unit 20 as a single heat source unit, indoor units 40, 50, 60 as a plurality (three in the present embodiment) of usage units connected in parallel to the outdoor unit, and a liquid refrigerant communication tube 71 and gas refrigerant communication tube 72 as refrigerant communication tubes connecting the outdoor unit 20 and the indoor units 40, 50, 60. Specifically, a vapor compression refrigerant circuit 11 of the air-conditioning apparatus 10 of the present embodiment is configured by connecting the outdoor unit 20, the indoor units 40, 50, 60, the liquid refrigerant communication tube 71, and the gas refrigerant communication tube 72.

(1-1) Indoor Units

The indoor units 40, 50, 60 are installed by being embedded in, suspended from, or otherwise mounted in the ceiling of a room of a building or the like; by being mounted on the wall surface of the room, or by another installation method. The indoor units 40, 50, 60 are connected to the outdoor unit 20 via the liquid refrigerant communication tube 71 and the gas refrigerant communication tube 72, and the indoor units constitute part of the refrigerant circuit 11.

Next, the configuration of the indoor units 40, 50, 60 will be described. Since the indoor unit 40 has the same configuration as the indoor units 50, 60, only the configuration of the indoor unit 40 is described herein, and the configurations of the indoor units 50, 60, which have reference numerals in the 50*s* and 60*s* in place of the 40*s* reference numerals denoting the components of the indoor unit 40, are not described.

The indoor unit 40 has primarily an indoor-side refrigerant circuit 11*a* constituting part of the refrigerant circuit 11 (the indoor unit 50 has an indoor-side refrigerant circuit 11*b* and the indoor unit 60 has an indoor-side refrigerant circuit 11*c*). The indoor-side refrigerant circuit 11*a* has primarily an indoor expansion valve 41 as an expansion mechanism, and an indoor heat exchanger 42 as a usage-side heat exchanger. In the present embodiment, indoor expansion valves 41, 51, 61 are provided respectively as expansion mechanisms to the indoor units 40, 50, 60, but the present invention is not limited as such, and an expansion mechanism (including an expansion valve) may be provided to the outdoor unit 20, or an expansion mechanism may be provided to a connecting unit independent of the indoor units 40, 50, 60 and/or the outdoor unit 20.

In the present embodiment, the indoor expansion valve 41 is an electric expansion valve connected to the liquid side of the indoor heat exchanger 42 in order to regulate or otherwise manipulate the flow rate of the refrigerant flowing through the indoor-side refrigerant circuit 11*a*, and the indoor expansion valve 41 can also block the passage of refrigerant.

In the present embodiment, the indoor heat exchanger 42 is a cross fin-type fin-and-tube heat exchanger configured from a heat transfer tube and numerous fins, and is a heat exchanger for functioning as an evaporator of refrigerant and cooling indoor air during the air-cooling operation, and functioning as a condenser of refrigerant and heating indoor air during the air-warming operation. In the present embodiment, the indoor heat exchanger 42 is a cross fin-type fin-and-tube heat exchanger, but is not limited as such and may be another type of heat exchanger.

In the present embodiment, the indoor unit 40 has an indoor fan 43 as an air-blower for drawing indoor air into the unit, and after the air has undergone heat exchange with the refrigerant in the indoor heat exchanger 42, the indoor fan 43 supplies this air as supply air back into the room. The indoor fan 43 is a fan capable of varying the flow rate of air supplied to the indoor heat exchanger 42 within a predetermined air flow rate range, and in the present embodiment, the indoor fan 43 is a centrifugal fan, a multiblade fan, or the like driven by a motor 43*m* composed of a DC fan motor or the like. In the present embodiment, the air flow rate setting mode of the indoor fan 43 can be set by a remote controller or another input apparatus, to either a fixed air flow rate mode in which the air flow rate is set to one of three fixed air flow rates: low in which the air flow rate is smallest, high in which the air flow rate is greatest, and medium in which the air flow rate is an intermediate flow rate between low and high; or to an automatic air flow rate mode in which the air flow rate is automatically varied from low to high according to the degree of superheat SH, the degree of subcooling SC, and/or other factors. Specifically, when the user has selected either "low," "medium." or "high," for example, fixed air flow rate mode takes effect with the air flow rate fixed at low, and when the user has selected "automatic." automatic air flow rate mode takes effect in which the air flow rate is automatically varied according to the operating state. In the present embodiment, the fan tap air flow rate of the indoor fan 43 is switched among three levels: "low," "medium," and "high," but is not limited to these three levels and may be switched among another number of levels such as ten, for example. An indoor fan air flow rate Ga, which is the air flow rate of the indoor fan 43, is calculated by the speed of the motor 43*m*. The indoor fan air flow rate Ga is not limited to being calculated by the speed of the motor 43*m*, and may be calculated based on the electric current value of the motor 43*m*, or calculated based on the set fan tap.

The indoor unit 40 is provided with various sensors. A liquid-side temperature sensor 44 for detecting the temperature of the refrigerant (i.e., the refrigerant temperature corresponding to the condensation temperature Tc during the air-warming operation or to the evaporation temperature Te during the air-cooling operation) is provided to the liquid side of the indoor heat exchanger 42. A gas-side temperature sensor 45 for detecting the temperature of the refrigerant is provided to the gas side of the indoor heat exchanger 42. An indoor temperature sensor 46 for detecting the temperature of the indoor air (i.e. the indoor temperature Tr) flowing into the unit is provided to the side of the indoor unit 40 that has an intake port for indoor air. In the present embodiment, the liquid-side temperature sensor 44, the gas-side temperature sensor 45, and the indoor temperature sensor 46 are composed of thermistors. The indoor unit 40 has an indoor-side control apparatus 47 for controlling the actions of the components constituting the indoor unit 40. The indoor-side control apparatus 47 has an air-conditioning capability calculation part 47*a* for calculating the current air-conditioning capability and the like of the indoor unit 40, and a required temperature calculation part 47*b* for calculating, based on the current air-conditioning capability, the required evaporation temperature Ter or the required condensation temperature Tcr needed to exhibit this capability. The indoor-side control apparatus 47 has a microcomputer, a memory 47*c*, and/or other components provided in order to control the indoor unit 40, and the indoor-side control apparatus 47 is designed to be capable of exchanging control signals and the like with a remote controller (not shown) for separately operating the indoor unit 40, or to be capable of exchanging control signals and the like with the outdoor unit 20 via a transmission line 80*a*.

(1-2) Outdoor Unit

The outdoor unit 20 is installed outdoors of the building or the like, and is connected to the indoor units 40, 50, 60 via the liquid refrigerant communication tube 71 and the gas refrigerant communication tube 72. The outdoor unit 20 and the indoor units 40, 50, 60 together constitute the refrigerant circuit 11.

Next, the configuration of the outdoor unit 20 will be described. The outdoor unit 20 has primarily an outdoor-side refrigerant circuit 11*d* constituting part of the refrigerant circuit 11. The outdoor-side refrigerant circuit 11*d* has primarily a compressor 21, a four-way switching valve 22, an outdoor heat exchanger 23 as a heat-source-side heat exchanger, an outdoor expansion valve 38 as an expansion mechanism, an accumulator 24, a liquid-side shutoff valve 26, and a gas-side shutoff valve 27.

The compressor 21 is a compressor capable of varying operation capacity, and in the present embodiment, the compressor 21 is a positive-displacement compressor driven by a motor 21*m* whose rotational speed is controlled by an inverter. In the present embodiment, there is only one compressor 21, but the compressor is not limited to one, and two or more compressors may be connected in parallel according to the number of indoor units connected and other factors.

The four-way switching valve 22 is a valve for switching the direction of refrigerant flow. During the air-cooling operation, to make the outdoor heat exchanger 23 function as a condenser of refrigerant compressed by the compressor 21 and to make the indoor heat exchangers 42, 52, 62 function as evaporators of refrigerant condensed in the outdoor heat exchanger 23, the discharge side of the compressor 21 and the gas side of the outdoor heat exchanger 23 can be connected, and the intake side of the compressor 21 (specifically, the accumulator 24) and the side of the gas refrigerant communication tube 72 can be connected (air-cooling operation state: refer to the solid lines of the four-way switching valve 22 in FIG. 1). During the air-warming operation, to make the indoor heat exchangers 42, 52, 62 function as condensers of refrigerant compressed by the compressor 21 and to make the outdoor heat exchanger 23 function as an evaporator of refrigerant condensed in the indoor heat exchangers 42, 52, 62, the discharge side of the compressor 21 and the side of the gas refrigerant communication tube 72 can be connected, and the intake side of the compressor 21 and the gas side of the outdoor heat exchanger 23 can be connected (air-warming operation state: refer to the dashed lines of the four-way switching valve 22 in FIG. 1).

In the present embodiment, the outdoor heat exchanger 23 is a cross fin-type fin-and-tube heat exchanger, and is equipment for conducting heat exchange with the refrigerant, using air as a heat source. The outdoor heat exchanger 23 is a heat exchanger that functions as a condenser of refrigerant during the air-cooling operation and functions as an evaporator of refrigerant during the air-warming operation. The gas side of the outdoor heat exchanger 23 is connected to the four-way switching valve 22, and the liquid side of the outdoor heat exchanger 23 is connected to the outdoor expansion valve 38. In the present embodiment, the outdoor heat exchanger 23 is a cross fin-type fin-and-tube heat exchanger, but is not limited as such and may be another type of heat exchanger.

In the present embodiment, the outdoor expansion valve 38 is an electric expansion valve disposed downstream of the outdoor heat exchanger 23 (connected to the liquid side of the outdoor heat exchanger 23 in the present embodiment) in the direction of refrigerant flow in the refrigerant circuit 11 during the air-cooling operation, in order to adjust the pressure, flow rate, and/or other characteristics of the refrigerant flowing through the outdoor-side refrigerant circuit 11*d*.

In the present embodiment, the outdoor unit 20 has an outdoor fan 28 as an air-blower for drawing outdoor air into the unit, and expelling the air back out after the air has undergone heat exchange with the refrigerant in the outdoor heat exchanger 23. The outdoor fan 28 is a fan capable of varying the flow rate of air supplied to the outdoor heat exchanger 23, and in the present embodiment, the outdoor fan 28 is a propeller fan or the like driven by a motor 28*m* composed of a DC fan motor or the like.

The liquid-side shutoff valve 26 and the gas-side shutoff valve 27 are valves provided to ports that connect to external equipment or pipes (specifically, the liquid refrigerant communication tube 71 and the gas refrigerant communication tube 72). The liquid-side shutoff valve 26 is disposed downstream of the outdoor expansion valve 38 and upstream of the liquid refrigerant communication tube 71 in the direction of refrigerant flow in the refrigerant circuit 11 during the air-cooling operation, and is also capable of blocking the passage of refrigerant. The gas-side shutoff valve 27 is connected to the four-way switching valve 22.

Figure 2:
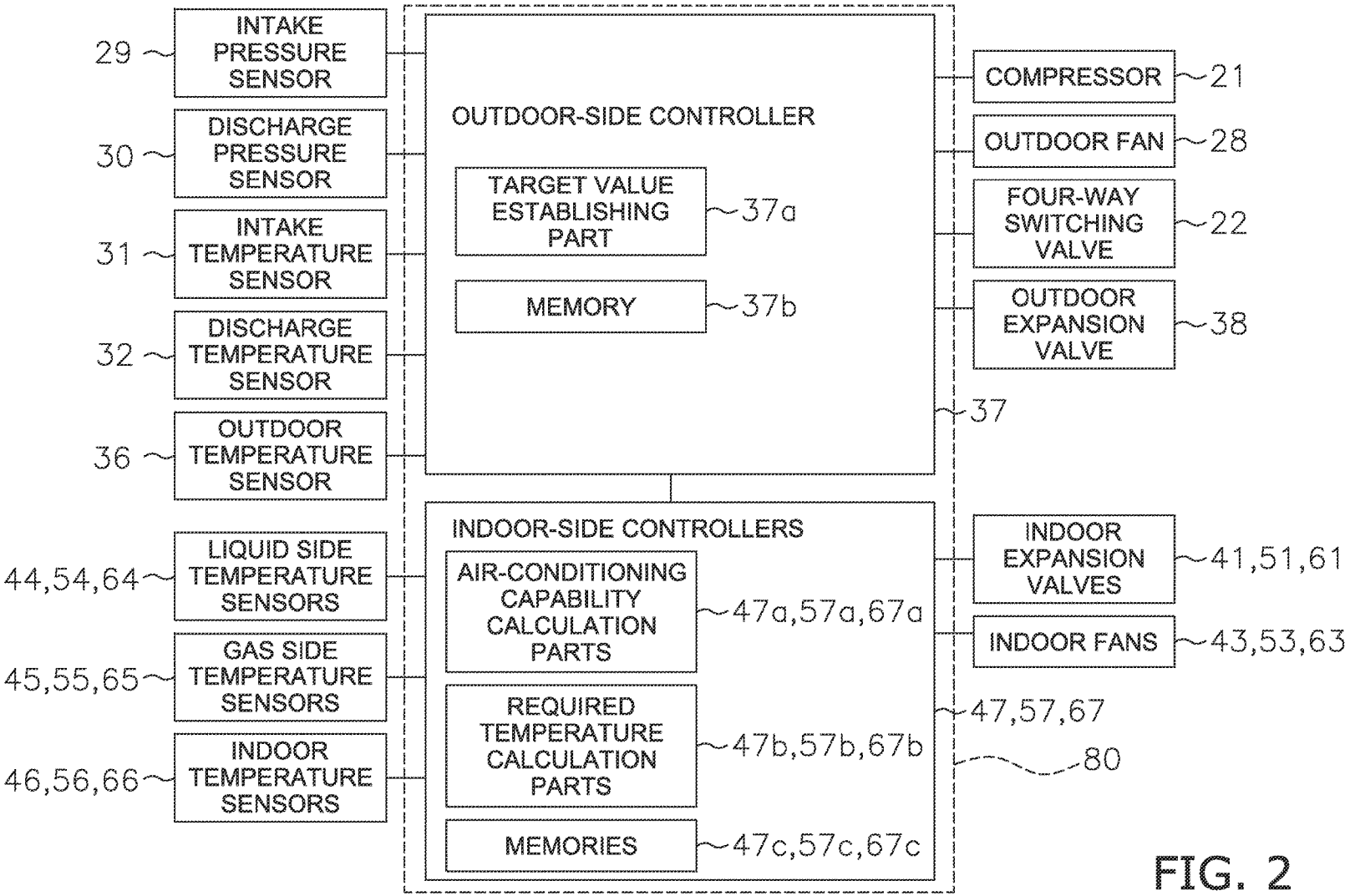
FIG. 2 is a control block diagram of the air-conditioning apparatus 10.

Various sensors are provided to the outdoor unit 20. Specifically, the outdoor unit 20 is provided with an intake pressure sensor 29 for detecting the intake pressure of the compressor 21 (i.e., the refrigerant pressure corresponding to the evaporation pressure Pe during the air-cooling operation), a discharge pressure sensor 30 for detecting the discharge pressure of the compressor 21 (i.e., the refrigerant pressure corresponding to the condensation pressure Pc during the air-warming operation), an intake temperature sensor 31 for detecting the intake temperature of the compressor 21, and a discharge temperature sensor 32 for detecting the discharge temperature of the compressor 21. An outdoor temperature sensor 36 for detecting the temperature of outdoor air flowing into the unit (i.e., the outdoor temperature) is provided to the outdoor air intake port side of the outdoor unit 20. In the present embodiment, the intake temperature sensor 31, the discharge temperature sensor 32, and the outdoor temperature sensor 36 are composed of thermistors. The outdoor unit 20 also has an outdoor-side control apparatus 37 for controlling the actions of the components constituting the outdoor unit 20. The outdoor-side control apparatus 37 has a target value establishing part 37*a* (refer to the description hereinafter) for establishing a target evaporation temperature difference ΔTet or a target condensation temperature difference ΔTct for controlling the operating capacity of the compressor 21, as shown in FIG. 2. The outdoor-side control apparatus 37 has a microcomputer provided in order to control the outdoor unit 20, a memory 37*b*, and/or an inverter circuit or the like for controlling the motor 21*m*, and the outdoor-side control apparatus 37 can exchange control signals and the like with the indoor-side control apparatuses 47, 57, 67 of the indoor units 40, 50, 60 via the transmission line 80*a*. Specifically, an operation control apparatus 80 as an operation control apparatus for performing operation control of the entire air-conditioning apparatus 10 is configured by the transmission line 80*a* which connects the indoor-side control apparatuses 47, 57, 67, the outdoor-side control apparatus 37, and the operation control apparatuses 37, 47, 57.

The operation control apparatus 80 is connected so as to be capable of receiving detection signals of the various sensors 29 to 32, 36, 39, 44 to 46, 54 to 56, and 64 to 66, and is also connected so as to be capable of controlling the various equipment and valves 21, 22, 28, 38, 41, 43, 51, 53, 61, 63 on the basis of these detection signals and the like, as shown in FIG. 2. Various data is stored in the memories 37*b*, 47*c*, 57*c*, 67*c* constituting the operation control apparatus 80. FIG. 2 is a control block diagram of the air-conditioning apparatus 10.

(1-3) Refrigerant Communication Tubes

The refrigerant communication tubes 71, 72 are refrigerant tubes that are constructed onsite when the air-conditioning apparatus 10 is installed in a building or another location of installation, and tubes of various lengths and/or diameters are used according to installation conditions such as the location of installation and/or the combination of outdoor units and indoor units. Therefore, when a new air-conditioning apparatus is installed, for example, the air-conditioning apparatus 10 must be filled with an amount of refrigerant that is suitable for the lengths and/or diameters of the refrigerant communication tubes 71, 72 and other installation conditions.

As described above, the indoor-side refrigerant circuits 11*a*, 11*b*, 11*c*, the outdoor-side refrigerant circuit 11*d*, and the refrigerant communication tubes 71, 72 are connected to configure the refrigerant circuit 11 of the air-conditioning apparatus 10. In the air-conditioning apparatus 10 of the present embodiment, the operation control apparatus 80 configured from the indoor-side control apparatuses 47, 57, 67 and the outdoor-side control apparatus 37 switches operation between the air-cooling operation and the air-warming operation through the four-way switching valve 22, and controls the equipment of the outdoor unit 20 and the indoor units 40, 50, 60 in accordance with the operation load of the indoor units 40, 50, 60.

(2) Action of Air-Conditioning Apparatus

Next, the action of the air-conditioning apparatus 10 of the present embodiment will be described.

In the air-conditioning apparatus 10, during the air-cooling operation and air-warming operation described hereinbelow, the indoor units 40, 50, 60 undergo indoor temperature control for bringing the indoor temperature Tr nearer to the set temperature Ts which the user has set through a remote controller or another input apparatus. In this indoor temperature control, when the indoor fans 43, 53, 63 have been set to the automatic air flow rate mode, the air flow rates of the indoor fans 43, 53, 63 and the opening degrees of the indoor expansion valves 41, 51, 61 are regulated so that the indoor temperature Tr converges on the set temperature Ts. When the indoor fans 43, 53, 63 have been set to the fixed air flow rate mode, the opening degrees of the indoor expansion valves 41, 51, 61 are regulated so that the indoor temperature Tr converges on the set temperature Ts. The phrase "the opening degrees of the indoor expansion valves 41, 51, 61 are regulated" used herein means that the degrees of superheat of the outlets of the indoor heat exchangers 42, 52, 62 are controlled in the case of the air-cooling operation, and that the degrees of subcooling of the outlets of the indoor heat exchangers 42, 52, 62 are controlled in the case of the air-warming operation.

(2-1) Air-Cooling Operation

First the air-cooling operation will be described using FIG. 1.

During the air-cooling operation, the four-way switching valve 22 is in the state shown by the solid lines of FIG. 1, i.e., the discharge side of the compressor 21 is connected to the gas side of the outdoor heat exchanger 23, and the intake side of the compressor 21 is connected to the gas side of the indoor heat exchangers 42, 52, 62 via the gas-side shutoff valve 27 and the gas refrigerant communication tube 72. The outdoor expansion valve 38 is fully opened. The liquid-side shutoff valve 26 and the gas-side shutoff valve 27 are opened. The opening degrees of the indoor expansion valves 41, 51, 61 are regulated so that the degrees of superheat SH of the refrigerant in the outlets of the indoor heat exchangers 42, 52, 62 (i.e. the gas sides of the indoor heat exchangers 42, 52, 62) stabilize at a target degree of superheat SHt. The target degree of superheat SHt is set to a temperature value that is optimal in order for the indoor temperature Tr to converge on the set temperature Ts within a predetermined degree of superheat range. In the present embodiment, the degrees of superheat SH of the refrigerant in the outlets of the indoor heat exchangers 42, 52, 62 are detected by subtracting the refrigerant temperature values (corresponding to the evaporation temperature Te) detected by the liquid-side temperature sensors 44, 54, 64 from the refrigerant temperature values detected by the gas-side temperature sensors 45, 55, 65. The degrees of superheat SH of the refrigerant in the outlets of the indoor heat exchangers 42, 52, 62 are not limited to being detected by the method described above, and may be detected by converting the intake pressure of the compressor 21 detected by the intake pressure sensor 29 to a saturation temperature value corresponding to the evaporation temperature Te, and subtracting this refrigerant saturation temperature value from the refrigerant temperature values detected by the gas-side temperature sensors 45, 55, 65. Though not employed in the present embodiment, temperature sensors may be provided for detecting the temperatures of refrigerant flowing through the indoor heat exchangers 42, 52, 62, and the degrees of superheat SH of the refrigerant in the outlets of the indoor heat exchangers 42, 52, 62 may be detected by subtracting the refrigerant temperature values corresponding to the evaporation temperature Te detected by these temperature sensors from the refrigerant temperature values detected by the gas-side temperature sensors 45, 55, 65.

When the compressor 21, the outdoor fan 28, and the indoor fans 43, 53, 63 are operated with the refrigerant circuit 11 in this state, low-pressure gas refrigerant is drawn into the compressor 21 and compressed to high-pressure gas refrigerant. The high-pressure gas refrigerant is then sent through the four-way switching valve 22 to the outdoor heat exchanger 23, subjected to heat exchange with outdoor air supplied by the outdoor fan 28, and condensed to high-pressure liquid refrigerant. The high-pressure liquid refrigerant is sent through the liquid-side shutoff valve 26 and the liquid refrigerant communication tube 71 to the indoor units 40, 50, 60.

The high-pressure liquid refrigerant sent to the indoor units 40, 50, 60 is depressurized nearly to the intake pressure of the compressor 21 by the indoor expansion valves 41, 51, 61, becoming low-pressure gas-liquid two-phase refrigerant, which is sent to the indoor heat exchangers 42, 52, 62, subjected to heat exchange with indoor air in the indoor heat exchangers 42, 52, 62, and evaporated to low-pressure gas refrigerant.

This low-pressure gas refrigerant is sent through the gas refrigerant communication tube 72 to the outdoor unit 20, and the refrigerant flows through the gas-side shutoff valve 27 and the four-way switching valve 22 to the accumulator 24. The low-pressure gas refrigerant that has flowed to the accumulator 24 is again drawn into the compressor 21. Thus, in the air-conditioning apparatus 10, it is possible to at least perform the air-cooling operation in which the outdoor heat exchanger 23 is made to function as a condenser of refrigerant compressed in the compressor 21, and the indoor heat exchangers 42, 52, 62 are made to function as evaporators of refrigerant that has been condensed in the outdoor heat exchanger 23 and then sent through the liquid refrigerant communication tube 71 and the indoor expansion valves 41, 51, 61. Because the air-conditioning apparatus 10 has no mechanism for regulating the pressure of refrigerant in the gas sides of the indoor heat exchangers 42, 52, 62, the evaporation pressures Pe in all of the indoor heat exchangers 42, 52, 62 are the same pressure.

Figure 3:
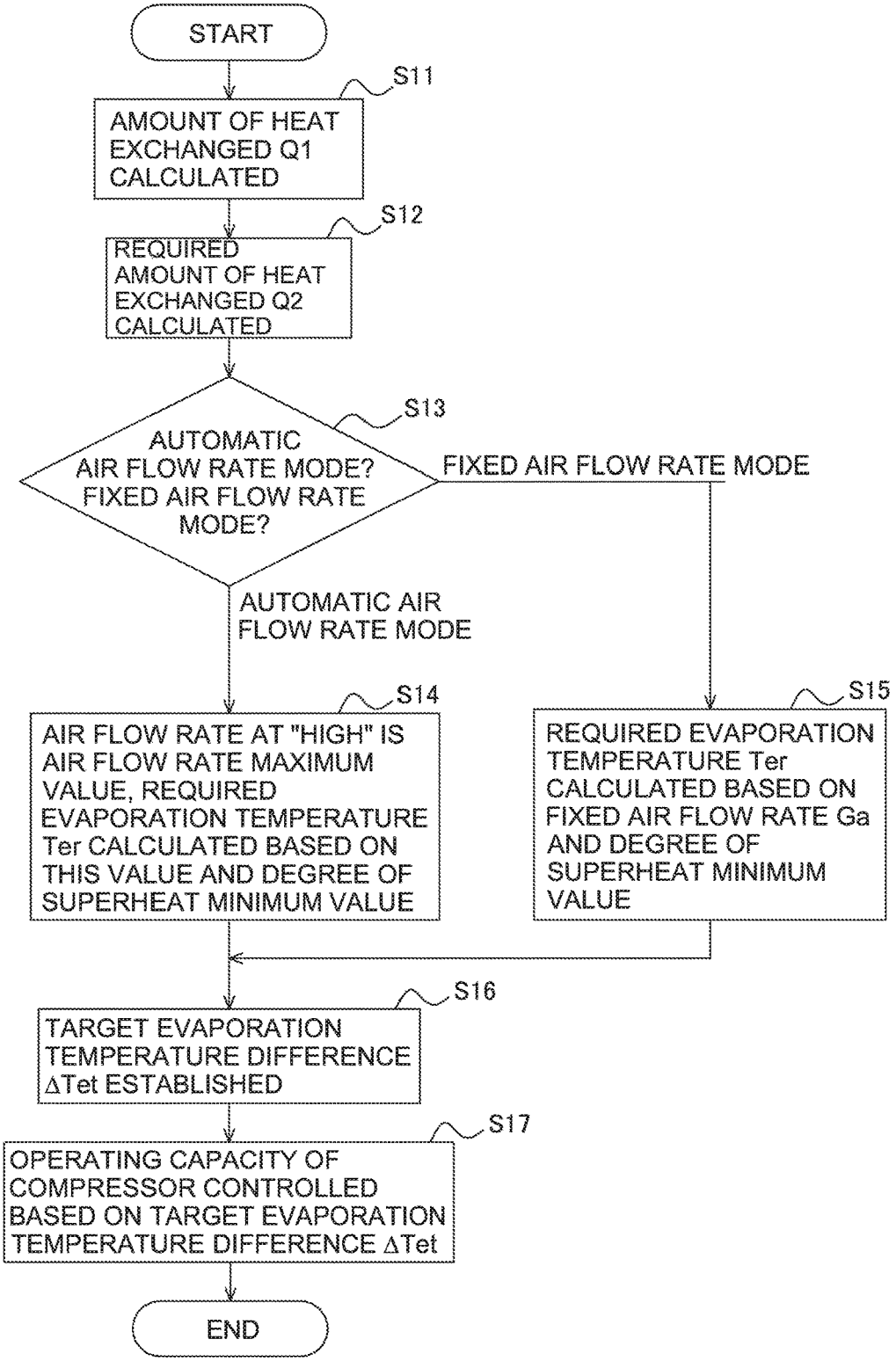
FIG. 3 is a flowchart showing the flow of energy conservation control in the air-cooling operation.

During this air-cooling operation in the air-conditioning apparatus 10 of the present embodiment, energy conservation control is performed based on the flowchart of FIG. 3. The energy conservation control in the air-cooling operation is described hereinbelow.

First, in step S11, the air-conditioning capability calculation parts 47*a*, 57*a*, 67*a* of the indoor-side control apparatuses 47, 57, 67 of the indoor units 40, 50, 60 calculate the amount of heat exchanged Q1 in the indoor units 40, 50, 60 on the basis of the following parameters in effect at the time: a temperature difference ΔTer which is the difference between the indoor temperature Tr and the evaporation temperature Te; the indoor fan air flow rates Ga blown by the indoor fans 43, 53, 63; and the degrees of superheat SH. The calculated amount of heat exchanged Q1 is stored in the memories 47*c*, 57*c*, 67*c* of the indoor-side control apparatuses 47, 57, 67. The amount of heat exchanged Q1 may be calculated using the evaporation temperature Te instead of the temperature difference ΔTer.

In step S12, the air-conditioning capability calculation parts 47*a*. 57*a*, 67*a* calculate required amount of heat exchanged Q2 by calculating a displacement ΔQ in the capability of conditioning indoor air on the basis of the temperature difference ΔT between the indoor temperature Tr detected by the indoor temperature sensors 46, 56, 66 and the set temperature Ts set by the user through the remote controller or the like at that time, and adding the displacement ΔQ to the amount of heat exchanged Q1. The calculated required amount of heat exchanged Q2 is stored in the memories 47*c*, 57*c*, 67*c* of the indoor-side control apparatuses 47, 57, 67. Though not shown in FIG. 3, when the indoor fans 43, 53, 63 are set to the automatic air flow rate mode in the indoor units 40, 50, 60 as described above, indoor temperature control is performed based on the required amount of heat exchanged Q2 to regulate the air flow rates of the indoor fans 43, 53, 63 and the opening degrees of the indoor expansion valves 41, 51, 61 so that the indoor temperature Tr converges on the set temperature Ts. When the indoor fans 43, 53, 63 have been set to the fixed air flow rate mode, indoor temperature control is performed based on the required amount of heat exchanged Q2 to regulate the opening degrees of the indoor expansion valves 41, 51, 61 so that the indoor temperature Tr converges on the set temperature Ts. Specifically, the air-conditioning capabilities of the indoor units 40, 50, 60 continue to be maintained between the above-described amount of heat exchanged Q1 and the required amount of heat exchanged Q2 by indoor temperature control.

In step S13, a confirmation is made as to whether the air flow rate setting mode in the remote controller of the indoor fans 43, 53, 63 is the automatic air flow rate mode or the fixed air flow rate mode. The process advances to step S14 when the air flow rate setting mode of the indoor fans 43, 53, 63 is the automatic air flow rate mode, and the process advances to step S15 when the air flow rate setting mode is the fixed air flow rate mode.

In step S14, the required temperature calculation parts 47*b*, 57*b*, 67*b* calculate the required evaporation temperatures Ter of the indoor units 40, 50, 60 on the basis of the required amount of heat exchanged Q2, the air flow rate maximum value $Ga_{MAX}$ of the indoor fans 43, 53, 63 (the air flow rate at "high"), and the degree of superheat minimum value $SH_{min}$. The required temperature calculation parts 47*b*, 57*b*, 67*b* also calculate an evaporation temperature difference ΔTe, which is obtained by subtracting the evaporation temperature Te detected by the liquid-side temperature sensor 44 at the time from the required evaporation temperature Ter. The term "degree of superheat minimum value $SH_{min}$" used herein refers to the minimum value within the range in which the degree of superheat can be set by regulating the opening degrees of the indoor expansion valves 41, 51, 61, and a different value is set depending on the model of the apparatus. In the indoor units 40, 50, 60, when the air flow rates of the indoor fans 43, 53, 63 and the degrees of superheat reach the air flow rate maximum value GaAux and the degree of superheat minimum value $SH_{min}$, a state can be created which yields greater amounts of heat exchanged in the indoor heat exchangers 42, 52, 62 than the current amounts. Therefore, an operating state amount involving the air flow rate maximum value $Ga_{MAX}$ and the degree of superheat minimum value $SH_{min}$ means an operating state amount that can create a state that yields greater amounts of heat exchanged in the indoor heat exchangers 42, 52, 62 than the current amounts. The calculated evaporation temperature difference ΔTe is stored in the memories 47*c*, 57*c*, 67*c* of the indoor-side control apparatuses 47, 57, 67.

In step S15, the required temperature calculation parts 47*b*, 57*b*, 67*b* calculate the required evaporation temperatures Ter of the indoor units 40, 50, 60 on the basis of the required amount of heat exchanged Q2, the fixed air flow rates Ga of the indoor fans 43, 53, 63 (the air flow rates at "medium," for example), and the degree of superheat minimum value $SH_{min}$. The required temperature calculation parts 47*b*, 57*b*, 67*b* also calculate evaporation temperature differences ΔTe, which are obtained by subtracting the evaporation temperature Te detected by the liquid-side temperature sensor 44 at the time from the required evaporation temperatures Ter. The calculated evaporation temperature differences ΔTe are stored in the memories 47*c*, 57*c*. 67*c* of the indoor-side control apparatuses 47, 57, 67. In step S15, the fixed air flow rates Ga are used rather than the air flow rate maximum value $Ga_{MAX}$, but this is because the user prioritizes the set air flow rate and the fixed air flow rates Ga will be recognized as the air flow rate maximum values within the range set by the user.

In step S16, the evaporation temperature differences ΔTe, which were stored in the memories 47*c*, 57*c*, 67*c* of the indoor-side control apparatuses 47, 57, 67 in steps S14 and S15, are sent to the outdoor-side control apparatus 37 and stored in the memory 37*b* of the outdoor-side control apparatus 37. The target value establishing part 37*a* of the outdoor-side control apparatus 37 establishes the minimum evaporation temperature difference $\Delta Te_{min}$ of the evaporation temperature differences ΔTe as the target evaporation temperature difference ΔTet. For example, when the ΔTe values of the indoor units 40, 50, 60 are 1° C., 0° C., and −2° C., $\Delta Te_{min}$ is −2° C.

In step S17, the operating capacity of the compressor 21 is controlled so as to approach the target evaporation temperature difference ΔTet. As a result of the operating capacity of the compressor 21 thus being controlled based on the target evaporation temperature difference ΔTet, in the indoor unit (the indoor unit 40 is assumed herein) that has calculated the minimum evaporation temperature difference $\Delta Te_{min}$ used as the target evaporation temperature difference ΔTet the indoor fan 43 is regulated so as to reach the air flow rate maximum value $Ga_{MAX}$ when automatic air flow rate mode has been set, and the indoor expansion valve 41 is regulated so that the degree of superheat SH in the outlet of the indoor heat exchanger 42 reaches the minimum value.

The calculation of the amount of heat exchanged Q1 in step S11 and the calculation of the evaporation temperature differences ΔTe performed in step S14 or step S15 are determined by an air-cooling heat exchange function, which differs with each of the indoor units 40, 50, 60 and takes into account the relationship of the air-conditioning (required) capability Q, the air flow rate Ga, the degree of superheat SH, and the temperature difference ΔTer of each of the indoor units 40, 50, 60. This air-cooling heat exchange function is a relational expression correlating the air-conditioning (required) capabilities Q, the air flow rates Ga, the degrees of superheat SH, and the temperature differences ΔTer representing the characteristics of the indoor heat exchangers 42, 52, 62, and is stored in the memories 47*c*, 57*c*, 67*c* of the indoor-side control apparatuses 47, 57, 67 of the indoor units 40, 50, 60. One variable among the air-conditioning (required) capability Q, the air flow rate Ga, the degree of superheat SH, and the temperature difference ΔTer is determined by inputting the other three variables into the air-cooling heat exchange function. The evaporation temperature difference ΔTe can thereby be accurately brought to the proper value, and the target evaporation temperature difference ΔTet can be reliably determined. Therefore, the evaporation temperature Te can be prevented from rising by too much. Consequently, excess and deficiency of the air-conditioning capabilities of the indoor units 40, 50, 60 can be prevented, the indoor units 40, 50, 60 can be quickly and stably brought to the optimal state, and a better energy conservation effect can be achieved.

The operating capacity of the compressor 21 is controlled based on the target evaporation temperature difference ΔTet in this flow, but is not limited to being controlled based on the target evaporation temperature difference ΔTet. The target value establishing part 37*a* may establish the minimum value of the required evaporation temperatures Ter calculated in the indoor units 40, 50, 60 as the target evaporation temperature Tet, and the operating capacity of the compressor 21 may be controlled based on the established target evaporation temperature Tet.

(2-1-2) Air-Warming Operation

Next, the air-warming operation will be described using FIG. 1.

During the air-warming operation, the four-way switching valve 22 is in the state shown by the dashed lines in FIG. 1 (the air-warming operation state), i.e., the discharge side of the compressor 21 is connected to the gas sides of the indoor heat exchangers 42, 52, 62 via the gas-side shutoff valve 27 and the gas refrigerant communication tube 72, and the intake side of the compressor 21 is connected to the gas side of the outdoor heat exchanger 23. The opening degree of the outdoor expansion valve 38 is regulated in order to reduce the pressure to a pressure at which the refrigerant flowing into the outdoor heat exchanger 23 can be evaporated in the outdoor heat exchanger 23 (i.e. an evaporation pressure Pe). The liquid-side shutoff valve 26 and the gas-side shutoff valve 27 are also opened. The opening degrees of the indoor expansion valves 41, 51, 61 are regulated so that the degrees of subcooling SC of the refrigerant in the outlets of the indoor heat exchangers 42, 52, 62 stabilize at a target degree of subcooling SCt. The target degree of subcooling SCt is set to the optimal temperature value in order to make the indoor temperature Tr converge on the set temperature Ts within the degree of subcooling range specified according to the operating state at the time. In the present embodiment, the degrees of subcooling SC of the refrigerant in the outlets of the indoor heat exchangers 42, 52, 62 are detected by converting the discharge pressure Pd of the compressor 21 detected by the discharge pressure sensor 30 to a saturation temperature value corresponding to the condensation temperature Tc, and subtracting the refrigerant temperature values detected by the liquid-side temperature sensors 44, 54, 64 from this refrigerant saturation temperature value. Though not used in the present embodiment, temperature sensors may be provided for detecting the temperature of refrigerant flowing through the indoor heat exchangers 42, 52, 62, and the degrees of subcooling SC of refrigerant in the outlets of the indoor heat exchangers 42, 52, 62 may be detected by subtracting the refrigerant temperature values corresponding to the condensation temperature Tc detected by these temperature sensors from the refrigerant temperature values detected by the liquid-side temperature sensors 44, 54, 64.

When the compressor 21, the outdoor fan 28, and the indoor fans 43, 53, 63 are operated with the refrigerant circuit 11 in this state, low-pressure gas refrigerant is drawn into the compressor 21 and compressed to high-pressure gas refrigerant, which is set through the four-way switching valve 22, the gas-side shutoff valve 27, and the gas refrigerant communication tube 72 to the indoor units 40, 50, 60.

The high-pressure gas refrigerant sent to the indoor units 40, 50, 60 is subjected to heat exchange with indoor air in the indoor heat exchangers 42, 52, 62 and condensed to high-pressure liquid refrigerant, and when this refrigerant then passes through the indoor expansion valves 41, 51, 61, the refrigerant is depressurized according to the valve opening degrees of the indoor expansion valves 41, 51, 61.

Having passed through the indoor expansion valves 41, 51, 61, the refrigerant is sent through the liquid refrigerant communication tube 71 to the outdoor unit 20, passed through the liquid-side shutoff valve 26 and the outdoor expansion valve 38, and further depressurized, after which the refrigerant flows into the outdoor heat exchanger 23. The low-pressure gas-liquid two-phase refrigerant flowing into the outdoor heat exchanger 23 is subjected to heat exchange with outdoor air supplied by the outdoor fan 28 and evaporated to low-pressure gas refrigerant, which flows through the four-way switching valve 22 into the accumulator 24. The low-pressure gas refrigerant flowing into the accumulator 24 is again drawn into the compressor 21. Because the air-conditioning apparatus 10 has no mechanisms for regulating the pressure of the refrigerant in the gas sides of the indoor heat exchangers 42, 52, 62, the condensation pressures Pc in all of the indoor heat exchangers 42, 52, 62 are the same pressure.

Figure 4:
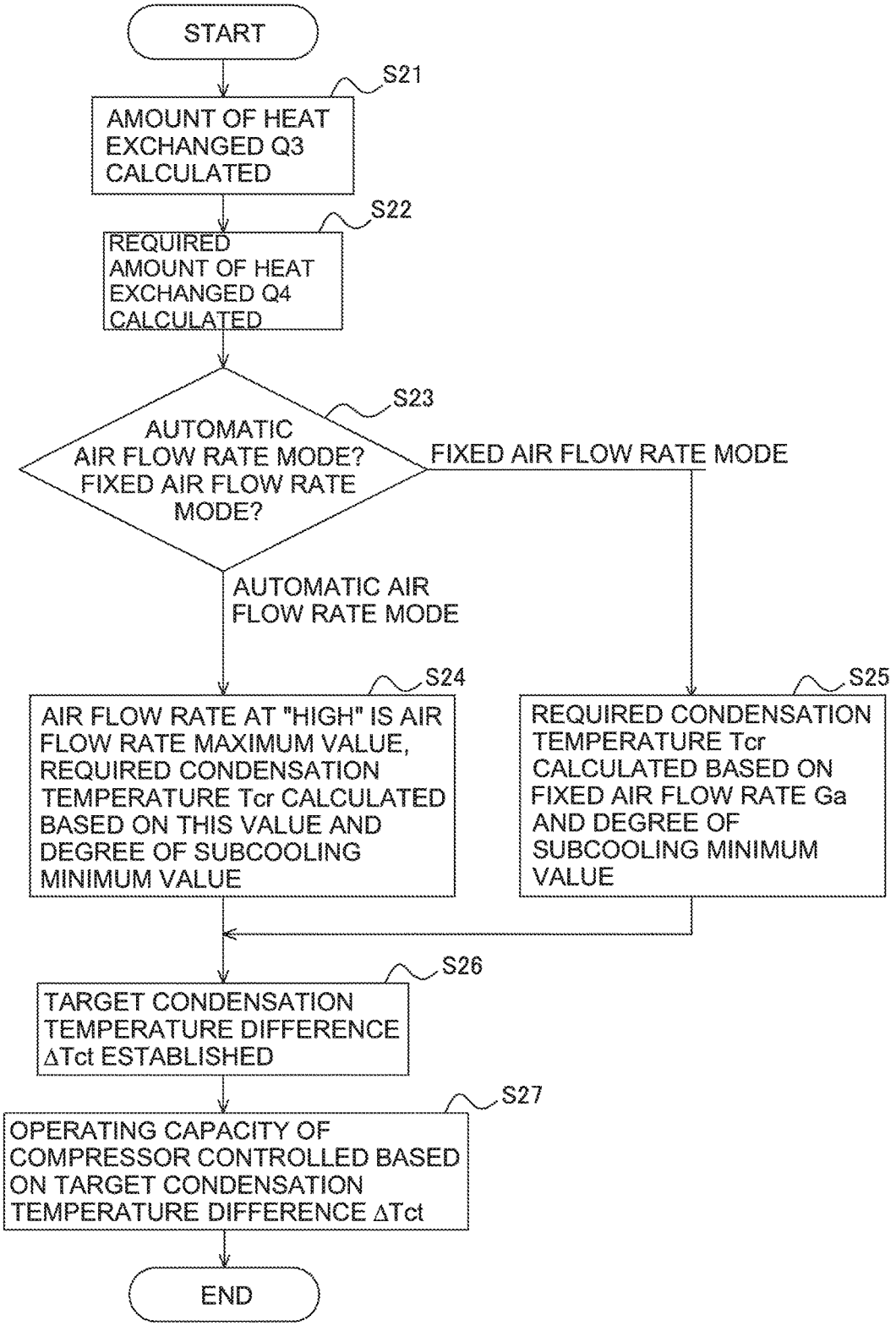
FIG. 4 is a flowchart showing the flow of energy conservation control in the air-warming operation.

In this air-warming operation in the air-conditioning apparatus 10 of the present embodiment, energy conservation control is performed based on the flowchart of FIG. 4. The energy conservation control in the air-warming operation is described hereinbelow.

First, in step S21, the air-conditioning capability calculation parts 47*a*, 57*a*, 67*a* of the indoor-side control apparatuses 47, 57, 67 of the indoor units 40, 50, 60 calculate the amount of heat exchanged Q3 in the indoor units 40, 50, 60 on the basis of the following parameters in effect at the time: a temperature difference ΔTcr which is the difference between the indoor temperature Tr and the condensation temperature Tc; the indoor fan air flow rates Ga blown by the indoor fans 43, 53, 63; and the degrees of subcooling SC. The calculated amount of heat exchanged Q3 is stored in the memories 47*c*, 57*c*. 67*c* of the indoor-side control apparatuses 47, 57, 67. The amount of heat exchanged Q3 may be calculated using the condensation temperature Te instead of the temperature difference ΔTcr.

In step S22, the air-conditioning capability calculation parts 47*a*, 57*a*, 67*a* calculate required amount of heat exchanged Q4 by calculating a displacement ΔQ in the capability of conditioning indoor air on the basis of the temperature difference ΔT between the indoor temperature Tr detected by the indoor temperature sensors 46, 56, 66 and the set temperature Ts set by the user through the remote controller or the like at that time, and adding the displacement ΔQ to the amount of heat exchanged Q3. The calculated required amount of heat exchanged Q4 is stored in the memories 47*c*, 57*c*, 67*c* of the indoor-side control apparatuses 47, 57, 67. Though not shown in FIG. 4, when the indoor fans 43, 53, 63 are set to the automatic air flow rate mode in the indoor units 40, 50, 60 as described above, indoor temperature control is performed based on the required amount of heat exchanged Q4 to regulate the air flow rates of the indoor fans 43, 53, 63 and the opening degrees of the indoor expansion valves 41, 51, 61 so that the indoor temperature Tr converges on the set temperature Ts. When the indoor fans 43, 53, 63 have been set to the fixed air flow rate mode, indoor temperature control is performed based on the required amount of heat exchanged Q4 to regulate the opening degrees of the indoor expansion valves 41, 51, 61 so that the indoor temperature Tr converges on the set temperature Ts. Specifically, the air-conditioning capabilities of the indoor units 40, 50, 60 continue to be maintained between the above-described amount of heat exchanged Q3 and the required amount of heat exchanged Q4 by indoor temperature control.

In step S23, a confirmation is made as to whether the air flow rate setting mode in the remote controller of the indoor fans 43, 53, 63 is the automatic air flow rate mode or the fixed air flow rate mode. The process advances to step S24 when the air flow rate setting mode of the indoor fans 43, 53, 63 is the automatic air flow rate mode, and the process advances to step S25 when the air flow rate setting mode is the fixed air flow rate mode.

In step S24, the required temperature calculation parts 47*b*, 57*b*, 67*b* calculate the required condensation temperatures Tcr of the indoor units 40, 50, 60 on the basis of the required amount of heat exchanged Q4, the air flow rate maximum value $Ga_{MAX}$ of the indoor fans 43, 53, 63 (the air flow rate at "high"), and the degree of subcooling minimum value $SC_{min}$. The required temperature calculation parts 47*b*, 57*b*, 67*b* also calculate a condensation temperature difference ΔTc, which is obtained by subtracting the condensation temperature Tc detected by the liquid-side temperature sensor 44 at the time from the required condensation temperatures Tcr. The term "degree of subcooling minimum value $SC_{min}$" used herein refers to the minimum value within the range in which the degree of subcooling can be set by regulating the opening degrees of the indoor expansion valves 41, 51, 61, and a different value is set depending on the model of the apparatus. In the indoor units 40, 50, 60, when the air flow rates of the indoor fans 43, 53, 63 and the degrees of subcooling reach the air flow rate maximum value $Ga_{MAX}$ and the degree of air flow rate minimum value $SC_{min}$, a state can be created which yields greater amounts of heat exchanged in the indoor heat exchangers 42, 52, 62 than the current amounts. Therefore, an operating state amount involving the air flow rate maximum value $Ga_{MAX}$ and the degree of air flow rate minimum value $SC_{min}$ means an operating state amount that can create a state that yields greater amounts of heat exchanged in the indoor heat exchangers 42, 52, 62 than the current amounts. The calculated condensation temperature difference ΔTc is stored in the memories 47*c*, 57*c*, 67*c* of the indoor-side control apparatuses 47, 57, 67.

In step S25, the required temperature calculation parts 47*b*, 57*b*, 67*b* calculate the required condensation temperatures Tcr of the indoor units 40, 50, 60 on the basis of the required amount of heat exchanged Q4, the fixed air flow rates Ga of the indoor fans 43, 53, 63 (the air flow rates at "medium," for example), and the degree of subcooling minimum value $SC_{min}$. The required temperature calculation parts 47*b*, 57*b*, 67*b* also calculate condensation temperature differences ΔTc, which are obtained by subtracting the condensation temperature Tc detected by the liquid-side temperature sensor 44 at the time from the required condensation temperatures Tcr. The calculated condensation temperature differences ΔTc are stored in the memories 47*c*, 57*c*, 67*c* of the indoor-side control apparatuses 47, 57, 67. In step S25, the fixed air flow rates Ga are used rather than the air flow rate maximum value $Ga_{MAX}$, but this is because the user prioritizes the set air flow rate, and the fixed air flow rates Ga will be recognized as the air flow rate maximum values within the range set by the user.

In step S26, the condensation temperature differences ΔTc, which were stored in the memories 47*c*, 57*c*, 67*c* of the indoor-side control apparatuses 47, 57, 67 in steps S24 and S25, are sent to the outdoor-side control apparatus 37 and stored in the memory 37*b* of the outdoor-side control apparatus 37. The target value establishing part 37*a* of the outdoor-side control apparatus 37 establishes the maximum condensation temperature difference $\Delta Tc_{MAX}$ of the condensation temperature differences ΔTc as the target condensation temperature difference ΔTct.

In step S27, the operating capacity of the compressor 21 is controlled based on the target condensation temperature difference ΔTct. As a result of the operating capacity of the compressor 21 thus being controlled based on the target condensation temperature difference ΔTct, in the indoor unit (the indoor unit 40 is assumed herein) that has calculated the maximum condensation temperature difference $\Delta Tc_{MAX}$ used as the target condensation temperature difference ΔTct, the indoor fan 43 is regulated so as to reach the air flow rate maximum value $Ga_{MAX}$ when automatic air flow rate mode has been set, and the indoor expansion valve 41 is regulated so that the degree of subcooling SC in the outlet of the indoor heat exchanger 42 reaches the minimum value.

The calculation of the amount of heat exchanged Q3 in step S21 and the calculation of the condensation temperature differences ΔTc performed in step S24 or step S25 are determined by an air-warming heat exchange function, which differs with each of the indoor units 40, 50, 60 and takes into account the relationship of the air-conditioning (required) capability Q, the air flow rate Ga, the degree of subcooling SC, and the temperature difference ΔTcr (the difference between the indoor temperature Tr and the condensation temperature Tc) of each of the indoor units 40, 50, 60. This air-warming heat exchange function is a relational expression correlating the air-conditioning (required) capabilities Q, the air flow rates Ga, the degrees of subcooling SC, and the temperature differences ΔTcr representing the characteristics of the indoor heat exchangers 42, 52, 62, and is stored in the memories 47*c*, 57*c*, 67*c* of the indoor-side control apparatuses 47, 57, 67 of the indoor units 40, 50, 60. One variable among the air-conditioning (required) capability Q, the air flow rate Ga, the degree of subcooling SC, and the temperature difference ΔTcr is determined by inputting the other three variables into the air-warming heat exchange function. The condensation temperature difference ΔTc can thereby be accurately brought to the proper value, and the target condensation temperature difference ΔTct can be reliably determined. Therefore, the condensation temperature Tc can be prevented from rising by too much. Consequently, excess and deficiency of the air-conditioning capabilities of the indoor units 40, 50, 60 can be prevented, the indoor units 40, 50, 60 can be quickly and stably brought to the optimal state, and a better energy conservation effect can be achieved.

The operating capacity of the compressor 21 is controlled based on the target condensation temperature difference ΔTct in this flow, but is not limited to being controlled based on the target condensation temperature difference ΔTct. The target value establishing part 37*a* may establish the maximum value of the required condensation temperatures Tcr calculated in the indoor units 40, 50, 60 as the target condensation temperature Tct. and the operating capacity of the compressor 21 may be controlled based on the established target condensation temperature Tct.

Operation control such as is described above is performed by the operation control apparatus 80, which functions as an operation control means for performing normal operations including the air-cooling operation and the air-warming operation (more specifically, the transmission line 80*a* connecting the indoor-side control apparatuses 47, 57, 67, the outdoor-side control apparatus 37, and the operation control apparatuses 37, 47, 57).

(3) Characteristics (3-1)

During the air-cooling operation in the operation control apparatus 80 of the air-conditioning apparatus 10 of the present embodiment, the air-conditioning capability calculation parts 47*a*, 57*a*, 67*a* calculate the current amount of heat exchanged Q1 in the indoor units 40, 50, 60 on the basis of the evaporation temperatures Te, the indoor fan air flow rates Ga blown by the indoor fans 43, 53, 63, and the degrees of superheat SH for each of the indoor units 40, 50, 60. The air-conditioning capability calculation parts 47*a*, 57*a*, 67*a* also calculate the required amount of heat exchanged Q2 on the basis of the calculated amount of heat exchanged Q1 and the displacements ΔQ of the air-conditioning capabilities. The required temperature calculation parts 47*b*, 57*b*, 67*b* calculate the required evaporation temperatures Ter of the indoor units 40, 50, 60 on the basis of the required amount of heat exchanged Q2, the air flow rate maximum value $Ga_{MAX}$ (the air flow rate at "high") of the indoor fans 43, 53, 63, and the degree of superheat minimum value $SH_{min}$.

During the air-warming operation, the air-conditioning capability calculation parts 47*a*, 57*a*, 67*a* calculate the current amount of heat exchanged Q3 in the indoor units 40, 50, 60 on the basis of the condensation temperatures Tc, the indoor fan air flow rates Ga blown by the indoor fans 43, 53, 63, and the degrees of subcooling SC for each of the indoor units 40, 50, 60. The air-conditioning capability calculation parts 47*a*, 57*a*, 67*a* also calculate the required amount of heat exchanged Q4 on the basis of the calculated amount of heat exchanged Q3 and the displacements ΔQ of the air-conditioning capabilities. The required temperature calculation parts 47*b*, 57*b*, 67*b* calculate the required condensation temperatures Tcr of the indoor units 40, 50, 60 on the basis of the required amount of heat exchanged Q4, the air flow rate maximum value $Ga_{MAX}$ (the air flow rate at "high") of the indoor fans 43, 53, 63, and the degree of subcooling minimum value $SC_{min}$.

Thus, the indoor-side control apparatuses 47, 57, 67, which include the air-conditioning capability calculation parts 47*a*, 57*a*. 67*a* and the required temperature calculation parts 47*b*, 57*b*, 67*b*, calculate the required evaporation temperature Ter or the required condensation temperature Tcr for each of the indoor units 40, 50, 60 on the basis of the amounts of heat exchanged Q1 and Q3, the air flow rate maximum value $Ga_{MAX}$, and the degree of superheat minimum value $SH_{min}$ (the degree of subcooling minimum value $SC_{min}$); therefore, the required evaporation temperatures Ter or the required condensation temperatures Tcr are calculated for a state in which the capabilities of the indoor heat exchangers 42, 52, 62 are better exhibited. It is therefore possible to determine the required evaporation temperatures Ter (or the required condensation temperatures Tcr) of a state in which the operating efficiencies of the indoor units 40, 50, 60 have been sufficiently improved, and to achieve the target evaporation temperature difference ΔTet (the target condensation temperature difference ΔTct) using the minimum (maximum) required evaporation temperature Ter among these required evaporation temperatures Ter (or required condensation temperatures Tcr). The target evaporation temperature difference ΔTet (the target condensation temperature difference ΔTct) can thereby be determined and operating efficiency can be sufficiently improved in accordance with the indoor unit having the greatest required air-conditioning capability of the indoor units 40, 50, 60 in a state in which the operating efficiencies of the indoor units 40, 50, 60 have been sufficiently improved.

(3-2)

With the operation control apparatus 80 of the air-conditioning apparatus 10 in the present embodiment, the air flow rates of the indoor fans 43, 53, 63 can be regulated within the predetermined air flow rate range, which is the air flow rate range from "low" to "high." When the indoor fans 43, 53, 63 have been set to the automatic air flow rate mode, the air flow rate at "high," which is the maximum value of the predetermined air flow rate range, is used as the air flow rate maximum value $Ga_{MAX}$ to calculate the required evaporation temperatures Ter or the required condensation temperatures Tcr. When the indoor fans 43, 53, 63 have been set to the fixed air flow rate mode, the fixed air flow rate (e.g. "medium") set by the user is used as the air flow rate maximum value $Ga_{MAX}$ to calculate the required evaporation temperatures Ter or the required condensation temperatures Tcr.

Consequently, in the air-conditioning apparatus 10 of the above embodiment, in cases in which there are both indoor units set to the automatic air flow rate mode and indoor units set to the fixed air flow rate mode and/or cases in which all of the indoor units 40, 50, 60 have been set to the fixed air flow rate mode, the air flow rate at "high," which is the maximum value of the predetermined air flow rate range, is used as the air flow rate maximum value $Ga_{MAX}$ regardless of the air flow rates of the indoor fans at that time in the indoor units in the automatic air flow rate mode, and the fixed air flow rate (e.g. "medium") set by the user is used as the air flow rate maximum value $Ga_{MAX}$ in the indoor units in the fixed air flow rate mode. Therefore, in the indoor units set to the fixed air flow rate mode, the required evaporation temperatures Ter or the required condensation temperatures Tcr can be calculated in a state that prioritizes the user's preference regarding the air flow rate, and in the other indoor units in the automatic air flow rate mode, the required evaporation temperatures Ter or the required condensation temperatures Tcr can be calculated in a state in which the air flow rate has been set to the air flow rate at "high" which is the maximum value of the predetermined air flow rate range. Operating efficiency can thereby be improved as much as possible while prioritizing the preferences of the user.

(3-3)

In the operation control apparatus 80 of the air-conditioning apparatus 10 in the present embodiment, capacity control of the compressor 21 is performed based on the target evaporation temperature difference ΔTet or the target condensation temperature difference ΔTct.

Consequently, the required evaporation temperature Ter (or the required condensation temperature Tcr) in the indoor unit having the greatest required air-conditioning capability can be set as the target evaporation temperature difference ΔTet (the target condensation temperature difference ΔTct). Therefore, the target evaporation temperature difference ΔTet (the target condensation temperature difference ΔTct) can be set so that there is no excess or deficiency in the indoor unit having the greatest required air-conditioning capability, and the compressor 21 can be driven with the minimum necessary capacity.

(4) Modifications (4-1) Modification 1

In the operation control apparatus 80 of the air-conditioning apparatus 10 in the above embodiment, the target evaporation temperature difference ΔTet or the target condensation temperature difference ΔTct is calculated, and capacity control of the compressor 21 is performed based on the target evaporation temperature difference ΔTet or the target condensation temperature difference ΔTct. Due to this capacity control of the compressor 21 being performed and the indoor expansion valves 41, 51, 61 or the indoor fans 43, 53, 63 being controlled so that the indoor temperature Tr approaches the set temperature Ts set by the user via a remote controller or the like, in the indoor unit (the indoor unit 40 is assumed in this case) that has calculated the minimum evaporation temperature difference $\Delta Te_{min}$ (the maximum condensation temperature difference $\Delta Tc_{MAX}$) used as the target evaporation temperature difference ΔTet (the target condensation temperature difference ΔTct), the indoor fan 43 is regulated so as to achieve the air flow rate maximum value $Ga_{MAX}$ when the indoor fan 43 has been set to the automatic air flow rate mode, and the indoor expansion valve 41 is regulated so that the degree of superheat SH (the degree of subcooling SC) of the outlet of the indoor heat exchanger 42 reaches the minimum value (the maximum value). Thus, capacity control of the compressor 21 is performed based on the target evaporation temperature difference ΔTet (the target condensation temperature difference ΔTct), and control of the indoor expansion valves 41, 51, 61 or the indoor fans 43, 53, 63 is performed as the situation stands so that the indoor temperature Tr approaches the set temperature Ts set by the user via a remote controller or the like, but the control is not limited to this situation, and an alternative is to establish the target evaporation temperature difference ΔTet (the target condensation temperature difference ΔTct), to establish the target degree of superheat SHt (the target degree of subcooling SCt) for regulating the opening degrees of the indoor expansion valves 41, 51, 61 and a target air flow rate Gat of the indoor fans 43, 53, 63, and to operate with the established opening degrees of the expansion valves and the established air flow rates of the indoor fans.

More specifically, the target degree of superheat SHt (the target degree of subcooling SCt) is calculated by the indoor-side control apparatuses 47, 57, 67 on the basis of the required amount of heat exchanged Q2 (Q4) calculated in the above embodiment, the target evaporation temperature difference ΔTet (the target condensation temperature difference ΔTct), and the current indoor fan air flow rate Ga. The target air flow rate Gat is calculated by the indoor-side control apparatuses 47, 57, 67 on the basis of the required amount of heat exchanged Q2 (Q4), the target evaporation temperature difference ΔTet (the target condensation temperature difference ΔTct), and the current degree of superheat SH (degree of subcooling SC).

(4-2) Modification 2

In the air-conditioning apparatus 10 in the above embodiment and Modification 1, the air flow rates of the indoor fans 43, 53, 63 provided to the indoor units 40, 50, 60 can be switched by the user between an automatic air flow rate mode and a fixed air flow rate mode, but the apparatus is not limited as such, and may use indoor units that can be set only to the automatic air flow rate mode or indoor units that can be set only to the fixed air flow rate mode.

In the case of indoor units that can be set only to the automatic air flow rate mode, steps S13 and S15 are omitted from the flow of the air-cooling operation in the above embodiment, and steps S23 and S25 are omitted from the flow of the air-warming operation.

In the case of indoor units that can be set only to the fixed air flow rate mode, steps S13 and S14 are omitted from the flow of the air-cooling operation in the above embodiment, and steps S23 and S25 are omitted from the flow of the air-warming operation.

(4-3) Modification 3

Figure 5:
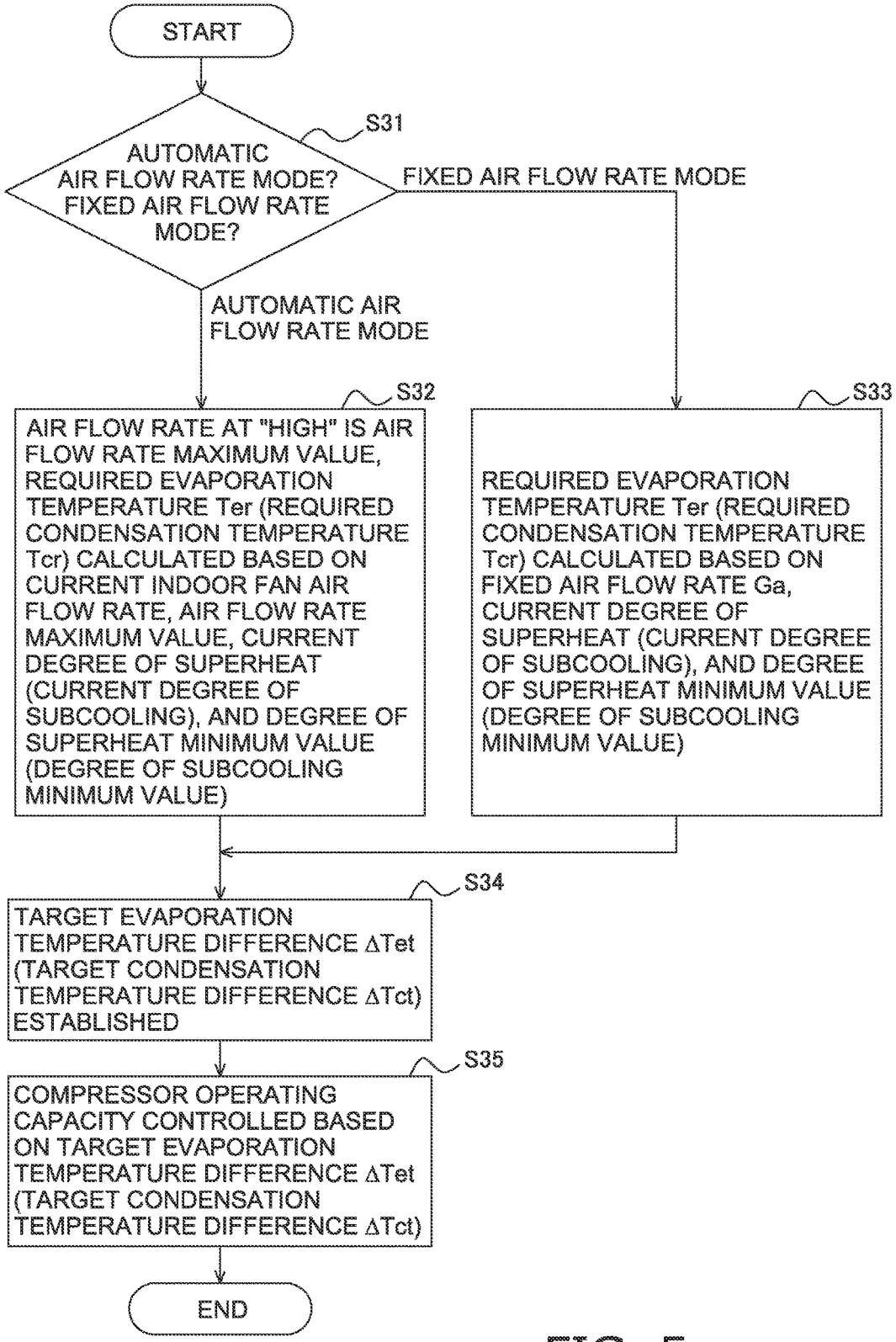
FIG. 5 is a flowchart showing the flow of energy conservation control according to Modification 3.

In the operation control apparatus 80 of the air-conditioning apparatus 10 in the above embodiment and Modifications 1 and 2, the air-conditioning capability calculation parts 47*a*, 57*a*, 67*a* calculate the amount of heat exchanged Q1 (Q3) in step S1 of the energy conservation control in the air-cooling operation or step S21 of the energy conservation control in the air-warming operation, but this calculation need not be performed. In this case, the energy conservation control of steps S31 to S35 is performed as shown in FIG. 5. A case of energy conservation control in the air-cooling operation is described hereinbelow, and parts of energy conservation control of the air-warming operation that are different from energy conservation control of the air-cooling operation are described in parentheses. Specifically, energy conservation control of the air-warming operation is control in which the wording of energy conservation control of the air-cooling operation is replaced with the wording in parentheses.

In step S31, a confirmation is made as to whether or not the air flow rate setting mode in the remote controller of the indoor fans 43, 53, 63 is the automatic air flow rate mode or the fixed air flow rate mode. The process advances to step S32 when the air flow rate setting mode of the indoor fans 43, 53, 63 is the automatic air flow rate mode, and the process advances to step S33 when it is the fixed air flow rate mode.

In step S32, the required temperature calculation parts 47*b*, 57*b*, 67*b* calculate the required evaporation temperatures Ter (the required condensation temperatures Tcr) of the indoor units 40, 50, 60 on the basis of the current indoor fan air flow rates Ga of the indoor fans 43, 53, 63, the air flow rate maximum value $Ga_{MAX}$ (the air flow rate at "high") of the indoor fans 43, 53, 63, the current degrees of superheat SH (the current degrees of subcooling SC), and the degree of superheat minimum value $SH_{min}$ (the degree of subcooling minimum value $SC_{min}$). The required temperature calculation parts 47*b*, 57*b*, 67*b* also calculate the evaporation temperature differences ΔTe (the condensation temperature differences ΔTc), which are obtained by subtracting the evaporation temperature Te (the condensation temperature Tc) detected by the liquid-side temperature sensor 44 at the time subtracted from the required evaporation temperatures Ter (the required condensation temperatures Tcr). The calculated evaporation temperature differences ΔTe (the condensation temperature differences ΔTc) are stored in the memories 47*c*, 57*c*, 67*c* of the indoor-side control apparatuses 47, 57, 67.

In step S33, the required temperature calculation parts 47*b*, 57*b*, 67*b* calculate the required evaporation temperatures Ter (the required condensation temperatures Tcr) of the indoor units 40, 50, 60 on the basis of the fixed air flow rates Ga (e.g. the air flow rates at "medium") of the indoor fans 43, 53, 63, the current degrees of superheat SH (the current degrees of subcooling SC), and the degree of superheat minimum value $SH_{min}$ (the degree of subcooling minimum value $SC_{min}$). The required temperature calculation parts 47*b*, 57*b*. 67*b* also calculate the evaporation temperature differences ΔTe (the condensation temperature differences ΔTe), which are obtained by subtracting the evaporation temperature Te (the condensation temperature Tc) detected by the liquid-side temperature sensor 44 at the time from the required evaporation temperatures Ter (the required condensation temperatures Tcr).

The calculated evaporation temperature differences ΔTe (the condensation temperature differences ΔTe) are stored in the memories 47*c*, 57*c*, 67*c* of the indoor-side control apparatuses 47, 57, 67. In this step S33, the fixed air flow rates Ga are used rather than the air flow rate maximum value $Ga_{MAX}$, but this is because the user prioritizes the set air flow rate, and the fixed air flow rates Ga will be recognized as the air flow rate maximum values within the range set by the user.

In step S34, the evaporation temperature differences ΔTe (the condensation temperature differences ΔTc), which were stored in the memories 47*c*, 57*c*, 67*c* of the indoor-side control apparatuses 47, 57, 67 in steps S32 and S33, are sent to the outdoor-side control apparatus 37 and stored in the memory 37*b* of the outdoor-side control apparatus 37. The target value establishing part 37*a* of the outdoor-side control apparatus 37 establishes the minimum evaporation temperature difference $\Delta Te_{min}$ (the maximum condensation temperature difference $\Delta T_{CMAX}$), which is the minimum of the evaporation temperature differences ΔTe (the condensation temperature differences ΔTc), as the target evaporation temperature difference ΔTet (the target condensation temperature difference ΔTct).

In step S35, the operating capacity of the compressor 21 is controlled so as to approach the target evaporation temperature difference ΔTet (the target condensation temperature difference ΔTct). As a result of the operating capacity of the compressor 21 thus being controlled based on the target evaporation temperature difference ΔTet (the target condensation temperature difference ΔTct), in the indoor unit (the indoor unit 40 is assumed herein) that has calculated the minimum evaporation temperature difference $\Delta Te_{min}$ (the maximum condensation temperature difference $\Delta Tc_{MAX}$) used as the target evaporation temperature difference ΔTet (the target condensation temperature difference ΔTct), the indoor fan 43 is regulated so as to reach the air flow rate maximum value $Ga_{MAX}$ when automatic air flow rate mode has been set, and the indoor expansion valve 41 is regulated so that the degree of superheat SH (the degree of subcooling SC) in the outlet of the indoor heat exchanger 42 reaches the minimum value.

In energy conservation control of steps S31 to S35 described above, the air-conditioning capability calculation parts 47*a*, 57*a*, 67*a* do not perform calculations of the amount of heat exchanged Q1 (Q3) and the required amount of heat exchanged Q2 (Q4), but they may perform calculations of the required amount of heat exchanged Q2 (Q4) directly without performing calculations of the amount of heat exchanged Q1 (Q3). For example, in step S12 (S22) of the above embodiment, the air-conditioning capability calculation parts 47*a*, 57*a*, 67*a* may calculate a temperature difference ΔT between the indoor temperature Tr detected by the indoor temperature sensors 46, 56, 66 and the set temperature Ts that has been set by the user via a remote controller or the like at the time, and may calculate the required amount of heat exchanged Q2 on the basis of this temperature difference ΔT, the indoor fan air flow rates Ga of the indoor fans 43, 53, 63, and the degrees of superheat SH; and steps S11 and S21 for calculating the amount of heat exchanged Q1 (Q3) may be omitted.

(4-4) Modification 4

In the above embodiment and Modifications 1 to 3, the required evaporation temperatures Ter (the required condensation temperatures Tcr) of the indoor units 40, 50, 60 were calculated based on the current indoor fan air flow rates Ga, the air flow rate maximum value $Ga_{MAX}$, the current degrees of superheat SH (the current degrees of subcooling SC), and the degree of superheat minimum value $SH_{min}$ (the degree of subcooling minimum value $SC_{min}$), but this calculation is not limited as such. Another option is to find air flow rate differences ΔGa which are the differences between the current indoor fan air flow rates Ga and the air flow rate maximum value $Ga_{MAX}$, and degree of superheat differences ΔSH (degree of subcooling differences ΔSC) which are the differences between the current degrees of superheat SH (the current degrees of subcooling SC) and the degree of superheat minimum value $SH_{min}$ (the degree of subcooling minimum value $SC_{min}$); and to calculate the required evaporation temperatures Ter (the required condensation temperatures Tcr) of the indoor units 40, 50, 60 on the basis of these air flow rate differences ΔGa and degree of superheat differences ΔSH (degree of subcooling differences ΔSC).

(4-5) Modification 5

In the operation control apparatus 80 of the air-conditioning apparatus 10 in the above embodiment and Modifications 1 to 4, in step S14 (S32) or step S15 (S33) of energy conservation control in the air-cooling operation, the required evaporation temperatures Ter of the indoor units 40, 50, 60 were calculated based not only on the air flow rate maximum value $Ga_{MAX}$ or the fixed air flow rate Ga as an air flow rate maximum value but also on the degree of superheat minimum value $SH_{min}$, but this calculation is not limited as such, and the required evaporation temperatures Ter of the indoor units 40, 50, 60 may be calculated based solely on the air flow rate maximum value $Ga_{MAX}$ or the fixed air flow rate Ga as an air flow rate maximum value. Similarly, in step S24 (S32) or step S25 (S33) of energy conservation control in the air-warming operation, the required condensation temperatures Tcr of the indoor units 40, 50, 60 were calculated based not only on the air flow rate maximum value $Ga_{MAX}$ or the fixed air flow rate Ga as an air flow rate maximum value but also on the degree of subcooling minimum value $SC_{min}$, but this calculation is not limited as such, and the required condensation temperatures Tcr of the indoor units 40, 50, 60 may be calculated based solely on the air flow rate maximum value $Ga_{MAX}$ or the fixed air flow rate Ga as an air flow rate maximum value.

(4-6) Modification 6

In the operation control apparatus 80 of the air-conditioning apparatus 10 in the above embodiment and Modifications 1 to 5, in step S14 (S32) or step S15 (S33) of energy conservation control in the air-cooling operation, the required evaporation temperatures Ter of the indoor units 40, 50, 60 were calculated based on the air flow rate maximum value $Ga_{MAX}$ or the fixed air flow rate Ga as an air flow rate maximum value and the degree of superheat minimum value $SH_{min}$, but this calculation is not limited as such, and the required evaporation temperatures Ter of the indoor units 40, 50, 60 may be calculated based solely on the degree of superheat minimum value $SH_{min}$. Similarly, in step S24 (S32) or step S25 (S33) of energy conservation control in the air-warming operation, the required condensation temperatures Tcr of the indoor units 40, 50, 60 were calculated based on the air flow rate maximum value $Ga_{MAX}$ or the fixed air flow rate Ga as an air flow rate maximum value and the degree of subcooling minimum value $SC_{min}$, but this calculation is not limited as such, and the required condensation temperatures Tcr of the indoor units 40, 50, 60 may be calculated based solely on the degree of subcooling minimum value $SC_{min}$.

(4-7) Modification 7

In the operation control apparatus 80 of the air-conditioning apparatus 10 in the above embodiment and Modifications 1 to 6, the indoor-side control apparatuses 47, 57, 67, which include the air-conditioning capability calculation parts 47*a*, 57*a*. 67*a* and the required temperature calculation parts 47*b*, 57*b*, 67*b*, calculate the required evaporation temperatures Ter or the required condensation temperatures Tcr in a heat exchange amount maximum state yielding the maximum limit of heat exchange amounts in the indoor heat exchangers 42, 52, 62, by calculating a required evaporation temperature Ter or a required condensation temperature Tcr for each of the indoor units 40, 50, 60, on the basis of the amounts of heat exchanged Q1, Q2 (Q3, Q4) equivalent to the current amounts of heat exchanged in the indoor heat exchangers 42, 52, 62 and also on the air flow rate maximum value $Ga_{MAX}$ and the degree of superheat minimum value $SH_{min}$ (the degree of subcooling minimum value $SC_{min}$) which are operating state amounts that cause the usage-side heat exchangers to yield greater amounts of heat exchanged than the current amounts. However, this calculation is not limited to calculating the required evaporation temperatures Ter or the required condensation temperatures Tcr in such a heat exchange amount maximum state, and the required evaporation temperatures Ter or the required condensation temperatures Tcr may be calculated in a heat exchange amount state that yields heat exchange amounts greater by a predetermined percentage (5% in the following description) than the current heat exchange amounts of the indoor heat exchangers 42, 52, 62, for example.

Figure 6:
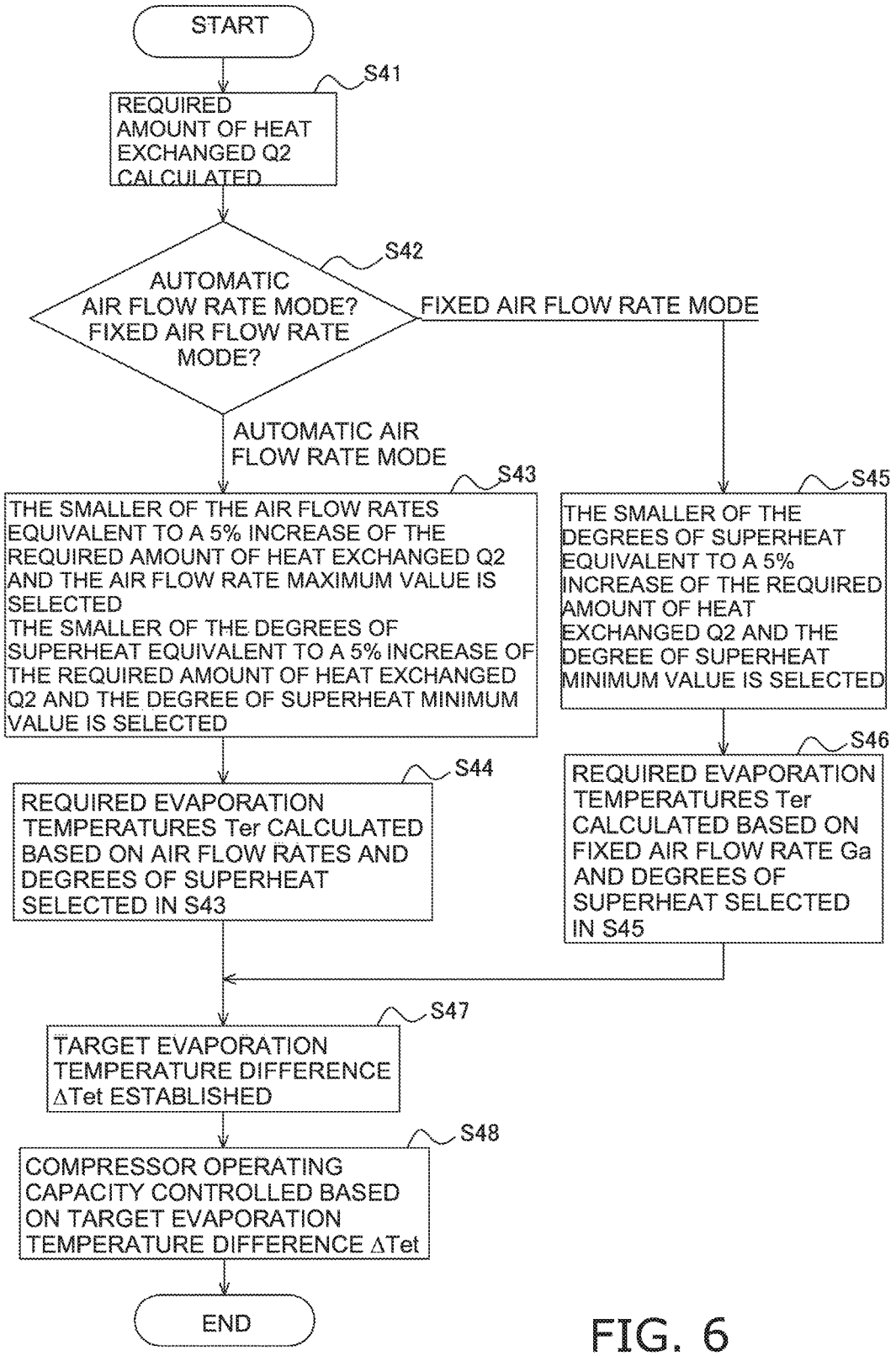
FIG. 6 is a flowchart showing the flow of energy conservation control in the air-cooling operation according to Modification 7.

In the present modification, energy conservation control is performed based on the flowchart of FIG. 6 in the air-cooling operation. The energy conservation control in the air-cooling operation is described hereinbelow.

First, in step S41, the air-conditioning capability calculation parts 47*a*, 57*a*, 67*a* of the indoor-side control apparatuses 47, 57, 67 of the indoor units 40, 50, 60 calculate a temperature difference ΔT between the indoor temperature Tr detected by the indoor temperature sensors 46, 56, 66 at that point in time and the set temperature Ts set by the user via a remote controller or the like at the time, and calculate the required amount of heat exchanged Q2 on the basis of the temperature difference ΔT, the indoor fan air flow rates Ga of the indoor fans 43, 53, 63, and the degrees of superheat SH. The amount of heat exchanged Q1 may be calculated and the required amount of heat exchanged Q2 may be calculated as in steps S11 and S12 of the above embodiment. The calculated required amount of heat exchanged Q2 is stored in the memories 47*c*, 57*c*, 67*c* of the indoor-side control apparatuses 47, 57, 67. Though not shown in FIG. 6, when the indoor fans 43, 53, 63 are set to the automatic air flow rate mode in the indoor units 40, 50, 60 as described above, indoor temperature control is performed for regulating the air flow rates of the indoor fans 43, 53, 63 and the opening degrees of the indoor expansion valves 41, 51, 61 so that the indoor temperature Tr converges on the set temperature Ts, based on the required amount of heat exchanged Q2. When the indoor fans 43, 53, 63 are set to the fixed air flow rate mode, indoor temperature control is performed for regulating the opening degrees of the indoor expansion valves 41, 51, 61 so that the indoor temperature Tr converges on the set temperature Ts, based on the required amount of heat exchanged Q2. Specifically, the air-conditioning capabilities of the indoor units 40, 50, 60 continue to be maintained the above-described required amount of heat exchanged Q2 by indoor temperature control.

In step S42, a confirmation is made as to whether the air flow rate setting mode in the remote controller of the indoor fans 43, 53, 63 is the automatic air flow rate mode or the fixed air flow rate mode. The process advances to step S43 when the air flow rate setting mode of the indoor fans 43, 53, 63 is the automatic air flow rate mode, and the process advances to step S45 when the air flow rate setting mode is the fixed air flow rate mode.

In step S43, based on the required amount of heat exchanged Q2 and the current air flow rates of the indoor fans 43, 53, 63, the required temperature calculation parts 47*b*, 57*b*, 67*b* calculate air flow rates equivalent to capabilities equal to the required amount of heat exchanged Q2 increased by a predetermined percentage (5% here) (hereinbelow referred to as the "air flow rates equivalent to a 5% increase of the required capabilities"). A comparison is made between these air flow rates equivalent to a 5% increase of the required capabilities and the air flow rate maximum value $Ga_{MAX}$ (the air flow rate at "high") of the indoor fans 43, 53, 63, and except for cases in which the air flow rate maximum value $Ga_{MAX}$ is less than the air flow rates equivalent to a 5% increase of the required capabilities, these air flow rates equivalent to a 5% increase of the required capabilities are selected as the air flow rates used in the calculation of the required evaporation temperatures Ter in the next step S44. Based on the required amount of heat exchanged Q2 and the current degrees of superheat in the outlets of the indoor heat exchangers 42, 52, 62, the required temperature calculation parts 47*b*, 57*b*, 67*b* calculate degrees of superheat equivalent to capabilities equal to the required amount of heat exchanged Q2 increased by a predetermined percentage (5% here) (hereinbelow referred to as the "degrees of superheat equivalent to a 5% increase of the required capabilities"). A comparison is made between these degrees of superheat equivalent to a 5% increase of the required capabilities and the degree of superheat minimum value $SH_{min}$, and except for cases in which the degree of superheat minimum value $SH_{min}$ is less than the degrees of superheat equivalent to a 5% increase of the required capabilities, the degrees of superheat equivalent to a 5% increase of the required capabilities are selected as the degrees of superheat used in the calculation of the required evaporation temperatures Ter in the next step S44.

In step S44, the required temperature calculation parts 47*b*, 57*b*, 67*b* calculate the required evaporation temperatures Ter of the indoor units 40, 50, 60 on the basis of the required amount of heat exchanged Q2 and the air flow rates in the indoor units 40, 50, 60 selected in step S43, and also on the basis of the degrees of superheat if the goal is to conserve more energy. The required temperature calculation parts 47*b*, 57*b*, 67*b* also calculate evaporation temperature differences ΔTe, which are obtained by subtracting the evaporation temperature Te detected by the liquid-side temperature sensor 44 at the time from the required evaporation temperatures Ter. The calculated evaporation temperature differences ΔTe are stored in the memories 47*c*, 57*c*, 67*c* of the indoor-side control apparatuses 47, 57, 67.

In step S45, based on the required amount of heat exchanged Q2 and the current degrees of superheat in the outlets of the indoor heat exchangers 42, 52, 62, the required temperature calculation parts 47*b*, 57*b*, 67*b* calculate degrees of superheat equivalent to capabilities equal to the required amount of heat exchanged Q2 increased by a predetermined percentage (5% here) (hereinbelow referred to as the "degrees of superheat equivalent to a 5% increase of the required capabilities"). A comparison is made between these degrees of superheat equivalent to a 5% increase of the required capabilities and the degree of superheat minimum value $SH_{min}$, and except for cases in which the degree of superheat minimum value $SH_{min}$ is less than the degrees of superheat equivalent to a 5% increase of the required capabilities, the degrees of superheat equivalent to a 5% increase of the required capabilities are selected as the degrees of superheat used in the calculation of the required evaporation temperatures Ter in the next step S46.

In step S46, the required temperature calculation parts 47*b*, 57*b*, 67*b* calculate the required evaporation temperatures Ter of the indoor units 40, 50, 60 on the basis of the required amount of heat exchanged Q2, the fixed air flow rates Ga of the indoor fans 43, 53, 63 (e.g. the air flow rates at "medium"), and the degrees of superheat in the indoor units 40, 50, 60 selected in step S45. The required temperature calculation parts 47*b*. 57*b*. 67*b* also calculate evaporation temperature differences ΔTe, which are obtained by subtracting the evaporation temperature Te detected by the liquid-side temperature sensor 44 at the time from the required evaporation temperatures Ter. The calculated evaporation temperature differences ΔTe are stored in the memories 47*c*, 57*c*, 67*c* of the indoor-side control apparatuses 47, 57, 67.

In step S47, the evaporation temperature differences ΔTe stored in the memories 47*c*, 57*c*, 67*c* of the indoor-side control apparatuses 47, 57, 67 in step S44 and step S46 are sent to the outdoor-side control apparatus 37 and stored in the memory 37*b* of the outdoor-side control apparatus 37. The target value establishing part 37*a* of the outdoor-side control apparatus 37 establishes a minimum evaporation temperature difference $\Delta Te_{min}$, which is the minimum among the evaporation temperature differences ΔTe, as the target evaporation temperature difference ΔTet.

In step S48, the operating capacity of the compressor 21 is controlled so as to approach the target evaporation temperature difference ΔTet. As a result of the operating capacity of the compressor 21 being thus controlled based on the target evaporation temperature difference ΔTet, in the indoor unit (the indoor unit 40 is assumed herein) that has calculated the minimum evaporation temperature difference $\Delta Te_{min}$ used as the target evaporation temperature difference ΔTet the indoor fan 43 is regulated so as to reach the air flow rate selected in step S43 (the air flow rate equivalent to a 5% increase of the required capability except for cases of the air flow rate maximum value $Ga_{MAX}$) when the indoor fan 43 has been set to the automatic air flow rate mode, and the indoor expansion valve 41 is regulated so that the degree of superheat SH in the outlet of the indoor heat exchanger 42 reaches the degree of superheat selected in step S43 or S45 (the degree of superheat equivalent to a 5% increase of the required capability except for cases of the degree of superheat minimum value $SH_{min}$).

The calculation of the required amount of heat exchanged Q2 in step S41 and the calculation of the evaporation temperature differences ΔTe performed in step S44 or step S46 are determined by an air-cooling heat exchange function, which differs with each of the indoor units 40, 50, 60 and takes into account the relationship of the required amount of heat exchanged Q2, the air flow rate Ga, the degree of superheat SH, and the temperature difference ΔTer of each of the indoor units 40, 50, 60. This air-cooling heat exchange function is a relational expression correlating the required amount of heat exchanged Q2, the air flow rates Ga, the degrees of superheat SH, and the temperature differences ΔTer representing the characteristics of the indoor heat exchangers 42, 52, 62, and is stored in the memories 47*c*, 57*c*, 67*c* of the indoor-side control apparatuses 47, 57, 67 of the indoor units 40, 50, 60. One variable among the required amount of heat exchanged Q2, the air flow rate Ga, the degree of superheat SH, and the temperature difference ΔTer is determined by inputting the other three variables into the air-cooling heat exchange function. The evaporation temperature difference ΔTe can thereby be accurately brought to the proper value, and the target evaporation temperature difference ΔTet can be reliably determined. Therefore, the evaporation temperature Te can be prevented from rising by too much. Consequently, excess and deficiency of the air-conditioning capabilities of the indoor units 40, 50, 60 can be prevented, the indoor units 40, 50, 60 can be quickly and stably brought to the optimal state, and a better energy conservation effect can be achieved.

The operating capacity of the compressor 21 is controlled based on the target evaporation temperature difference ΔTet in this flow, but is not limited to being controlled based on the target evaporation temperature difference ΔTet. The target value establishing part 37*a* may establish the minimum value of the required evaporation temperatures Ter calculated in the indoor units 40, 50, 60 as the target evaporation temperature Tet, and the operating capacity of the compressor 21 may be controlled based on the established target evaporation temperature Tet.

Figure 7:
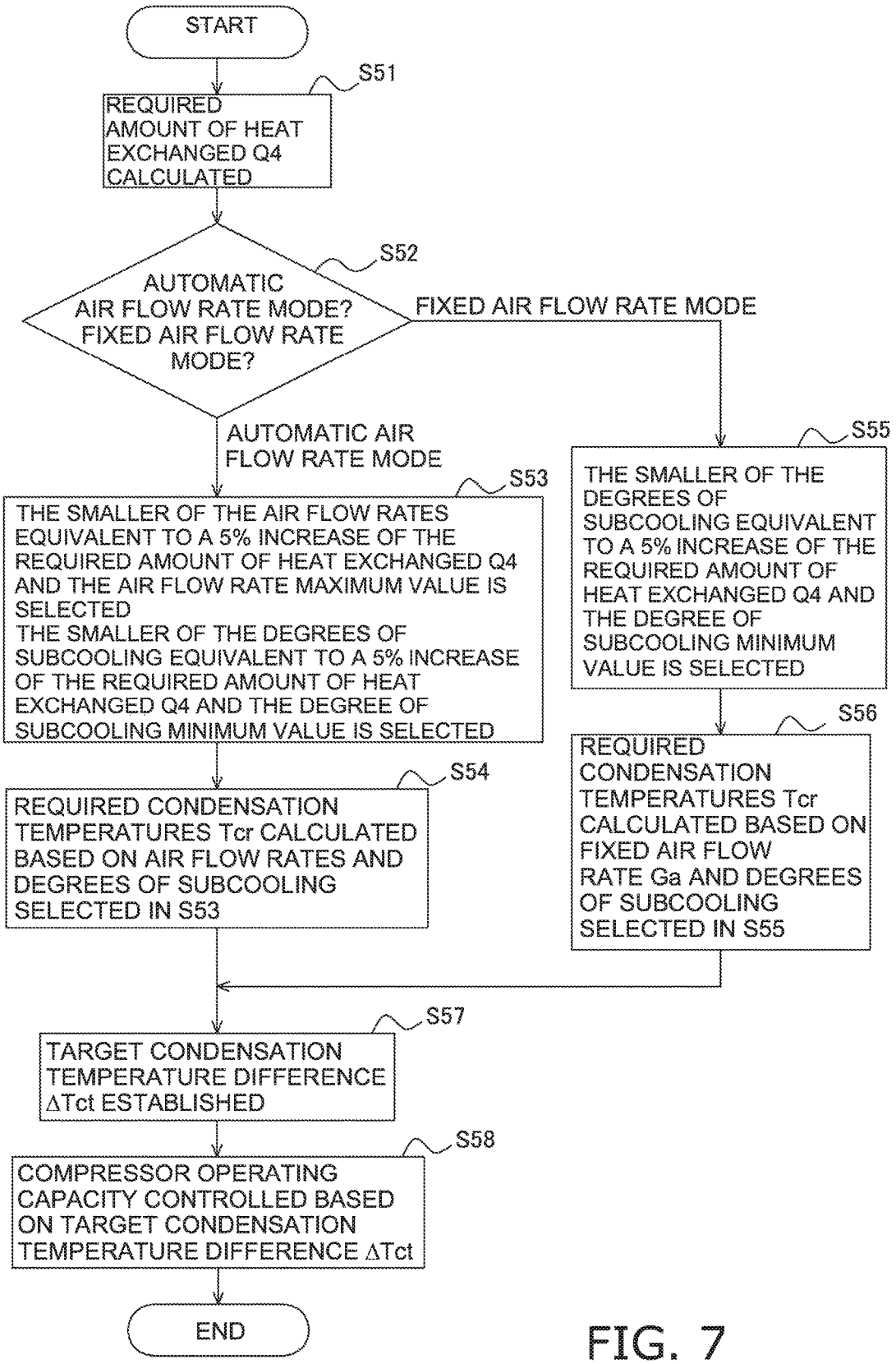
FIG. 7 is a flowchart showing the flow of energy conservation control in the air-warming operation according to Modification 7.

In the air-warming operation in the present modification, energy conservation control is performed based on the flowchart of FIG. 7. The energy conservation control in the air-warming operation is described hereinbelow.

First, in step S51, the air-conditioning capability calculation parts 47*a*. 57*a*, 67*a* of the indoor-side control apparatuses 47, 57, 67 of the indoor units 40, 50, 60 calculate a temperature difference ΔT between the indoor temperature Tr detected by the indoor temperature sensors 46, 56, 66 at that point in time and the set temperature Ts set by the user via a remote controller or the like at the time, and calculate the required amount of heat exchanged Q4 on the basis of the temperature difference ΔT, the indoor fan air flow rates Ga of the indoor fans 43, 53, 63, and the degrees of subcooling SC. The amount of heat exchanged Q3 may be calculated and the required amount of heat exchanged Q4 may be calculated as in steps S21 and S22 of the above embodiment. The calculated required amount of heat exchanged Q4 is stored in the memories 47*c*, 57*c*, 67*c* of the indoor-side control apparatuses 47, 57, 67. Though not shown in FIG. 7, when the indoor fans 43, 53, 63 are set to the automatic air flow rate mode in the indoor units 40, 50, 60 as described above, indoor temperature control is performed for regulating the air flow rates of the indoor fans 43, 53, 63 and the opening degrees of the indoor expansion valves 41, 51, 61 so that the indoor temperature Tr converges on the set temperature Ts, based on the required amount of heat exchanged Q4. When the indoor fans 43, 53, 63 are set to the fixed air flow rate mode, indoor temperature control is performed for regulating the opening degrees of the indoor expansion valves 41, 51, 61 so that the indoor temperature Tr converges on the set temperature Ts, based on the required amount of heat exchanged Q4. Specifically, the air-conditioning capabilities of the indoor units 40, 50, 60 continue to be maintained the above-described required amount of heat exchanged Q4 by indoor temperature control.

In step S52, a confirmation is made as to whether the air flow rate setting mode in the remote controller of the indoor fans 43, 53, 63 is the automatic air flow rate mode or the fixed air flow rate mode. The process advances to step S53 when the air flow rate setting mode of the indoor fans 43, 53, 63 is the automatic air flow rate mode, and the process advances to step S55 when the air flow rate setting mode is the fixed air flow rate mode.

In step S53, based on the required amount of heat exchanged Q4 and the current air flow rates of the indoor fans 43, 53, 63, the required temperature calculation parts 47*b*, 57*b*, 67*b* calculate air flow rates equivalent to capabilities equal to the required amount of heat exchanged Q4 increased by a predetermined percentage (5% here) (hereinbelow referred to as the "air flow rates equivalent to a 5% increase of the required capabilities"). A comparison is made between these air flow rates equivalent to a 5% increase of the required capabilities and the air flow rate maximum value $Ga_{MAX}$ (the air flow rate at "high") of the indoor fans 43, 53, 63, and except for cases in which the air flow rate maximum value $Ga_{MAX}$ is less than the air flow rates equivalent to a 5% increase of the required capabilities, these air flow rates equivalent to a 5% increase of the required capabilities are selected as the air flow rates used in the calculation of the required condensation temperatures Tcr in the next step S54. Based on the required amount of heat exchanged Q4 and the current degrees of subcooling in the outlets of the indoor heat exchangers 42, 52, 62, the required temperature calculation parts 47*b*, 57*b*, 67*b* calculate degrees of subcooling equivalent to capabilities equal to the required amount of heat exchanged Q4 increased by a predetermined percentage (5% here) (hereinbelow referred to as the "degrees of subcooling equivalent to a 5% increase of the required capabilities"). A comparison is made between these degrees of subcooling equivalent to a 5% increase of the required capabilities and the degree of subcooling minimum value $SC_{min}$, and except for cases in which the degree of subcooling minimum value $SC_{min}$ is less than the degrees of subcooling equivalent to a 5% increase of the required capabilities, the degrees of subcooling equivalent to a 5% increase of the required capabilities are selected as the degrees of subcooling used in the calculation of the required condensation temperatures Tcr in the next step $54.

In step S54, the required temperature calculation parts 47*b*, 57*b*, 67*b* calculate the required condensation temperatures Tcr of the indoor units 40, 50, 60 on the basis of the required amount of heat exchanged Q4, the air flow rates in the indoor units 40, 50, 60 selected in step S53, and the degrees of subcooling. The required temperature calculation parts 47*b*, 57*b*, 67*b* also calculate condensation temperature differences ΔTc, which are obtained by subtracting the condensation temperature Tc detected by the liquid-side temperature sensor 44 at the time from the required condensation temperatures Tcr. The calculated condensation temperature differences ΔTc are stored in the memories 47*c*, 57*c*, 67*c* of the indoor-side control apparatuses 47, 57, 67.

In step S55, based on the required amount of heat exchanged Q4 and the current degrees of subcooling in the outlets of the indoor heat exchangers 42, 52, 62, the required temperature calculation parts 47*b*, 57*b*, 67*b* calculate degrees of subcooling equivalent to capabilities equal to the required amount of heat exchanged Q4 increased by a predetermined percentage (5% here) (hereinbelow referred to as the "degrees of subcooling equivalent to a 5% increase of the required capabilities"). A comparison is made between these degrees of subcooling equivalent to a 5% increase of the required capabilities and the degree of subcooling minimum value $SC_{min}$, and except for cases in which the degree of subcooling minimum value $SC_{min}$ is less than the degrees of subcooling equivalent to a 5% increase of the required capabilities, the degrees of subcooling equivalent to a 5% increase of the required capabilities are selected as the degrees of subcooling used in the calculation of the required condensation temperatures Tcr in the next step S56.

In step S56, the required temperature calculation parts 47*b*, 57*b*, 67*b* calculate the required condensation temperatures Tcr of the indoor units 40, 50, 60 on the basis of the required amount of heat exchanged Q4, the fixed air flow rates Ga of the indoor fans 43, 53, 63 (e.g. the air flow rates at "medium"), and the degrees of subcooling in the indoor units 40, 50, 60 selected in step S55. The required temperature calculation parts 47*b*, 57*b*, 67*b* also calculate condensation temperature differences ΔTc, which are obtained by subtracting the condensation temperature Tc detected by the liquid-side temperature sensor 44 at the time from the required condensation temperatures Tcr. The calculated condensation temperature differences ΔTc are stored in the memories 47*c*, 57*c*, 67*c* of the indoor-side control apparatuses 47, 57, 67.

In step S57, the condensation temperature differences ΔTc stored in the memories 47*c*, 57*c*, 67*c* of the indoor-side control apparatuses 47, 57, 67 in step S54 and step S56 are sent to the outdoor-side control apparatus 37 and stored in the memory 37*b* of the outdoor-side control apparatus 37. The target value establishing part 37*a* of the outdoor-side control apparatus 37 establishes a maximum condensation temperature difference $\Delta Tc_{MAX}$, which is the maximum among the condensation temperature differences ΔTc, as the target condensation temperature difference ΔTct.

In step S58, the operating capacity of the compressor 21 is controlled so as to approach the target condensation temperature difference ΔTct. As a result of the operating capacity of the compressor 21 being thus controlled based on the target condensation temperature difference ΔTct, in the indoor unit (the indoor unit 40 is assumed herein) that has calculated the maximum condensation temperature difference $\Delta Tc_{MAX}$ used as the target condensation temperature difference ΔTct, the indoor fan 43 is regulated so as to reach the air flow rate selected in step S53 (the air flow rate equivalent to a 5% increase of the required capability except for cases of the air flow rate maximum value $Ga_{MAX}$) when the indoor fan 43 has been set to the automatic air flow rate mode, and the indoor expansion valve 41 is regulated so that the degree of subcooling SC in the outlet of the indoor heat exchanger 42 reaches the degree of subcooling selected in step S53 or S55 (the degree of subcooling equivalent to a 5% increase of the required capability except for cases of the degree of subcooling minimum value $SC_{min}$).

The calculation of the required amount of heat exchanged Q4 in step S51 and the calculation of the condensation temperature differences ΔTc performed in step S54 or step S56 are determined by an air-warming heat exchange function, which differs with each of the indoor units 40, 50, 60 and takes into account the relationship of the required amount of heat exchanged Q4, the air flow rate Ga, the degree of subcooling SC, and the temperature difference ΔTcr of each of the indoor units 40, 50, 60. This air-warming heat exchange function is a relational expression correlating the required amount of heat exchanged Q4, the air flow rates Ga, the degrees of subcooling SC, and the temperature differences ΔTcr representing the characteristics of the indoor heat exchangers 42, 52, 62, and is stored in the memories 47*c*, 57*c*, 67*c* of the indoor-side control apparatuses 47, 57, 67 of the indoor units 40, 50, 60. One variable among the required amount of heat exchanged Q4, the air flow rate Ga, the degree of subcooling SC, and the temperature difference ΔTcr is determined by inputting the other three variables into the air-warming heat exchange function. The condensation temperature differences ΔTc can thereby be accurately brought to the proper value, and the target condensation temperature difference ΔTct can be reliably determined. Therefore, the condensation temperature Tc can be prevented from rising by too much. Consequently, excess and deficiency of the air-conditioning capabilities of the indoor units 40, 50, 60 can be prevented, the indoor units 40, 50, 60 can be quickly and stably brought to the optimal state, and a better energy conservation effect can be achieved.

The operating capacity of the compressor 21 is controlled based on the target condensation temperature difference ΔTct in this flow, but is not limited to being controlled based on the target condensation temperature difference ΔTct. The target value establishing part 37*a* may establish the minimum value of the required condensation temperatures Tcr calculated in the indoor units 40, 50, 60 as the target condensation temperature Tct, and the operating capacity of the compressor 21 may be controlled based on the established target condensation temperature Tct.

(4-8) Modification 8

In the above embodiment and Modifications 1 to 7, examples were described in which the present invention was applied to the air-conditioning apparatus 10 having a plurality of indoor units, but the present invention can also be applied to the air-conditioning apparatus 10 having only one indoor unit. In this case, in the operation control apparatus 80 of the above embodiment and Modifications 1 to 7, the target value establishing part 37*a* and steps S16, S26, S34, S47, S57 become unnecessary, and capacity control of the compressor 21 is performed using the required evaporation temperature (the required condensation temperature) as the target evaporation temperature (the target condensation temperature).

In this case as well, a required evaporation temperature or a required condensation temperature in a state that yields better capability of the indoor heat exchanger is calculated, because the required evaporation temperature or the required condensation temperature is calculated based on either the current amount of heat exchanged in the indoor heat exchanger and a greater amount of heat exchanged in the indoor heat exchanger than the current amount, or an operating state amount (air flow rate, degree of superheat, and/or degree of subcooling) that yields the current amount of heat exchanged in the indoor heat exchanger and an operating state amount (air flow rate, degree of superheat, and/or degree of subcooling) that yields a greater amount of heat exchanged in the indoor heat exchanger than the current amount. Consequently, a required evaporation temperature or a required condensation temperature can be found that sufficiently improves the operating efficiency of the indoor unit, and the operating efficiency can thereby be sufficiently improved.

CITATION LIST

Patent Literature

[Patent Literature 1] Japanese Laid-open Patent Application No. 2-57875

What is claimed is:

1. An operation control apparatus of an air-conditioning apparatus having an outdoor unit and an indoor unit, the air-conditioning apparatus configured to perform indoor temperature control so that an indoor temperature approaches a set temperature, the operation control apparatus comprising:

a controller programmed to execute energy conservation control of the air conditioning apparatus, the indoor unit including an adjustable indoor air blower, and the controller including at least one required temperature calculation part calculating a required evaporation temperature of the indoor unit based on either a current amount of heat exchanged in a usage-side heat exchanger of the indoor unit and a greater amount of heat exchanged in the usage-side heat exchanger than the current amount by a displacement which is determined based on a temperature difference between the indoor temperature and the set temperature, or an air flow rate of the adjustable indoor air blower that yields the current amount of heat exchanged in the usage-side heat exchanger and an air flow rate of the adjustable indoor air blower that yields the greater amount of heat exchanged in the usage-side heat exchanger than the current amount.

2. The operation control apparatus of an air-conditioning apparatus according to claim 1, wherein the required temperature calculation part uses at least a current air flow rate of the adjustable indoor air blower of the indoor unit and an air flow rate greater than the current air flow rate within a predetermined air flow rate range of the indoor air blower as the operating state amount that yields the current amount of heat exchanged in the usage-side heat exchanger and the operating state amount that yields the greater amount of heat exchanged in the usage-side heat exchanger than the current amount, when calculating the required evaporation temperature or the required condensation temperature.

3. The operation control apparatus of an air-conditioning apparatus according to claim 2, wherein the controller further includes an air-conditioning capability calculation part calculating the amount of heat exchanged in the usage-side heat exchanger based on the air flow rate of the indoor air blower and/or the degree of superheat or degree of subcooling in the outlets of the usage-side heat exchangers.

4. The operation control apparatus of an air-conditioning apparatus according to claim 1, wherein the required temperature calculation part uses at least either a degree of superheat in an outlet of the usage side heat exchanger less than a current degree of superheat within a range of degrees of superheat in which the degree of superheat is settable by regulating an opening degree of an expansion mechanism of the indoor unit as well as the current degree of superheat, or a degree of subcooling in the outlet of the usage side heat exchanger less than a current degree of subcooling within a range of degrees of subcooling in which the degree of subcooling is settable by regulating the opening degree of the expansion mechanism as well as the current degree of subcooling, as the operating state amount that yields the current amount of heat exchanged in the usage-side heat exchanger and the operating state amount that yields the greater amount of heat exchanged in the usage-side heat exchanger than the current amount, when calculating the required evaporation temperature or the required condensation temperature.

5. The operation control apparatus of an air-conditioning apparatus according to claim 1, wherein the required temperature calculation part uses at least a current air flow rate of the adjustable indoor air blower of the indoor unit and an air flow rate maximum value that is the air flow rate of the indoor air blower maximized within a predetermined air flow rate range of the indoor air blower, as the operating state amount that yields the current amount of heat exchanged in the usage-side heat exchanger and the operating state amount that yields the greater amount of heat exchanged in the usage-side heat exchanger than the current amount, when calculating the required evaporation temperature or the required condensation temperature.

6. The operation control apparatus of an air-conditioning apparatus according to claim 1, wherein the required temperature calculation part uses at least either a current degree of superheat in an outlet of the usage side heat exchanger and a degree of superheat minimum value which is a minimum in a range of degrees of superheat in which the degree of superheat is settable by regulating an opening degree of an expansion mechanism of the indoor unit, or a current degree of subcooling in the outlet of the usage side heat exchanger and a degree of subcooling minimum value which is a minimum in a range of degrees of subcooling in which the degree of subcooling is settable by regulating the opening degree of the expansion mechanism, as the operating state amount that yields the current amount of heat exchanged in the usage-side heat exchanger and the operating state amount that yields the greater amount of heat exchanged in the usage-side heat exchanger than the current amount, when calculating the required evaporation temperature or the required condensation temperature.

7. The operation control apparatus of an air-conditioning apparatus according to claim 1, wherein the controller is configured to perform capacity control of a compressor of the outdoor unit based on a target evaporation temperature or a target condensation temperature, and the required evaporation temperature or the required condensation temperature is used as the target evaporation temperature or the target condensation temperature, respectively.

8. The operation control apparatus of an air-conditioning apparatus according to claim 1, wherein the controller includes a plurality of the required temperature calculation parts calculating the required evaporation temperature for each of a plurality of indoor units, and the controller further includes a target value establishing part configured to establish a target evaporation temperature based on a minimum required evaporation temperature among the required evaporation temperatures of the indoor units calculated in the required temperature calculation parts.

9. The operation control apparatus of an air-conditioning apparatus according to claim 8, wherein the required temperature calculation parts use at least current air flow rates of a plurality of adjustable indoor air blowers of the indoor units and air flow rates greater than the current air flow rates within a predetermined air flow rate range, respectively, as air flow rates of the adjustable indoor air blowers that yield the current amounts of heat exchanged in the usage-side heat exchangers and air flow rates of the adjustable indoor air blowers that yield greater amounts of heat exchanged in the usage-side heat exchangers than the current amounts, when calculating the required evaporation temperature for each indoor unit.

10. The operation control apparatus of an air-conditioning apparatus according to claim 8, wherein the required temperature calculation parts, when calculating the required evaporation temperature or the required condensation temperature for each indoor unit, use at least either current degrees of superheat in outlets of the usage side heat exchangers and degrees of superheat less than the current degrees of superheat within a range of degrees of superheat in which the degrees of superheat are settable by regulating opening degrees of expansion mechanisms of the indoor units, or current degrees of subcooling in outlets of the usage side heat exchangers and degrees of subcooling less than the current degrees of subcooling within a range of degrees of subcooling in which the degrees of subcooling are settable by regulating the opening degrees of the expansion mechanisms, as the operating state amount that yields the current amounts of heat exchanged in the usage-side heat exchangers and the operating state amount that yields the greater amounts of heat exchanged in the usage-side heat exchangers than the current amounts.

11. The operation control apparatus of an air-conditioning apparatus according to claim 8, wherein the required temperature calculation parts use at least current air flow rates of a plurality of adjustable indoor air blowers of the indoor units and an air flow rate maximum value that is the air flow rates of the indoor air blowers maximized within a predetermined air flow rate range, respectively, as the operating state amount that yields the current amounts of heat exchanged in the usage-side heat exchangers and the operating state amount that yields the greater amounts of heat exchanged in the usage-side heat exchangers than the current amounts, when calculating the required evaporation temperatures or the required condensation temperatures for each indoor unit.

12. The operation control apparatus of an air-conditioning apparatus according to claim 8, wherein the required temperature calculation parts, when calculating the required evaporation temperature or the required condensation temperature for each indoor unit, use at least either current degrees of superheat in outlets of the usage side heat exchangers and a degree of superheat minimum value which is the minimum in a range of degrees of superheat in which the degrees of superheat are settable by regulating the opening degrees of the expansion mechanisms, or current degrees of subcooling in outlets of the usage side heat exchangers and a degree of subcooling minimum value which is the minimum in a range of degrees of subcooling in which the degrees of subcooling are settable by regulating the opening degrees of the expansion mechanisms, as the operating state amount that yields the current amounts of heat exchanged in the usage-side heat exchangers and the operating state amount that yields the greater amounts of heat exchanged in the usage-side heat exchangers than the current amounts.

13. The operation control apparatus of an air-conditioning apparatus according to claim 8, wherein the controller is configured to perform capacity control of a compressor of the outdoor unit based on the target evaporation temperatures or the target condensation temperatures.

14. An operation control apparatus of an air-conditioning apparatus having an outdoor unit and an indoor unit, the air-conditioning apparatus configured to perform indoor temperature control so that an indoor temperature approaches a set temperature, the operation control apparatus comprising:

a controller programmed to execute energy conservation control of the air conditioning apparatus, the indoor unit including an adjustable indoor air blower, and the controller including at least one required temperature calculation part calculating a required condensation temperature of the indoor unit based on either a current amount of heat exchanged in a usage-side heat exchanger of the indoor unit and a greater amount of heat exchanged in the usage-side heat exchanger than the current amount by a displacement which is determined based on a temperature difference between the indoor temperature and the set temperature, or an air flow rate of the adjustable indoor air blower that yields the current amount of heat exchanged in the usage-side heat exchanger and an air flow rate of the adjustable indoor air blower that yields the greater amount of heat exchanged in the usage-side heat exchanger than the current amount.

15. The operation control apparatus of an air-conditioning apparatus according to claim 14, wherein the controller includes a plurality of the required temperature calculation parts calculating the required condensation temperature for each of a plurality of indoor units, and the controller further includes a target value establishing part configured to establish a target condensation temperature based on a maximum required condensation temperature among the required condensation temperatures of the indoor units calculated in the required temperature calculation parts.

16. The operation control apparatus of an air-conditioning apparatus according to claim 15, wherein the required temperature calculation parts use at least current air flow rates of a plurality of adjustable indoor air blowers of the indoor units and air flow rates greater than the current air flow rates within a predetermined air flow rate range, respectively, as air flow rates of the adjustable indoor air blowers that yield the current amounts of heat exchanged in the usage-side heat exchangers and air flow rates of the adjustable indoor air blowers that yield greater amounts of heat exchanged in the usage-side heat exchangers than the current amounts, when calculating the required condensation temperature for each indoor unit.

* * * * *